US011117707B1

(12) United States Patent
Song et al.

(10) Patent No.: US 11,117,707 B1
(45) Date of Patent: Sep. 14, 2021

(54) FOLDABLE BOX WITH INWARDLY FOLDING BOTTOM

(71) Applicants: Jae Ho Song, Yongin-si (KR); Won Seok Song, Yongin-si (KR); Bo Kyoung Song, Suwon-si (KR)

(72) Inventors: Jae Ho Song, Yongin-si (KR); Won Seok Song, Yongin-si (KR); Bo Kyoung Song, Suwon-si (KR)

( * ) Notice: Subject to any disclaimer, the term of this patent is extended or adjusted under 35 U.S.C. 154(b) by 0 days.

(21) Appl. No.: 16/987,084

(22) Filed: Aug. 6, 2020

(30) Foreign Application Priority Data

Feb. 25, 2020 (KR) ..... 10-2020-0023084

(51) Int. Cl.

| | |
|---|---|
| ***B65D 6/18*** | (2006.01) |
| ***B65D 21/08*** | (2006.01) |
| ***B65D 21/02*** | (2006.01) |
| ***B65D 25/30*** | (2006.01) |
| ***B65D 25/20*** | (2006.01) |

(52) U.S. Cl.
CPC ..... *B65D 21/086* (2013.01); *B65D 21/0212* (2013.01); *B65D 25/20* (2013.01); *B65D 25/30* (2013.01); *B65D 11/184* (2013.01); *B65D 11/186* (2013.01); *B65D 11/1833* (2013.01); *B65D 11/1846* (2013.01); *B65D 11/1853* (2013.01)

(58) Field of Classification Search
CPC ..... B65D 21/086; B65D 25/20; B65D 25/30; B65D 21/0212; B65D 11/1853; B65D 11/1846; B65D 11/184; B65D 11/186; B65D 11/1833
USPC ..... 220/6
See application file for complete search history.

(56) References Cited

FOREIGN PATENT DOCUMENTS

| | | | |
|---|---|---|---|
| JP | 2019167092 | A | 10/2019 |
| KR | 101179611 | B1 | 9/2012 |
| KR | 101444737 | B1 | 9/2014 |
| KR | 101996188 | B1 | 7/2019 |
| KR | 1020150011668 | B1 | 9/2019 |

OTHER PUBLICATIONS

Decision to Grant / Notice of Patent Allowance from priority application in Korea; dated Aug. 14, 2020; indicative of degree of relevance of references above.

*Primary Examiner* — Stephen J Castellano
(74) *Attorney, Agent, or Firm* — Egbert, McDaniel & Swartz, PLLC

(57) ABSTRACT

Provided is a foldable box having a left part and a right part, the left and right parts which include a pair of left auxiliary plates and a pair of right auxiliary plates, respectively, and most of which is made of a hard material, and therefore, it is possible to protect an item stored therein from an external impact and easily fold or unfold the foldable box, thereby maximizing convenience of storage and use.

4 Claims, 29 Drawing Sheets

FOLDABLE BOX WITH INWARDLY FOLDING BOTTOM

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present disclosure relates to a foldable box, and more particularly, to a foldable box having a space to store an item therein and capable of being unfolded or folded inward to minimize the volume.

2. Description of Related Art Including Information Disclosed Under 37 CFR 1.97 and 37 CFR 1.98

In general, a box made of synthetic resin, which requires a cushioning property, light weight, and impact resistance, is mainly used when repeatedly carrying or storing an item without a separate cushioning material, and a storage space for storing the item is formed in the box.

Such a storage box requires a storage space equal to the volume of the box itself when the item is stored therein.

However, if the box is empty, there is a need for a space for storing only the empty box without any items stored therein, so there is a lot of inconvenience such as waste of space for storing the empty box and poor portability.

Accordingly, the conventional packing box of foldable foam plastic (Korean Patent No. 10-1179611) discloses a technology for, when the box has no item stored therein or is carried around without any item stored therein, separating an upper lid and a lower lid and folding a body inward by pressing a folding part provided in a body inward.

However, the conventional packing box of foldable foam plastic has a problem that it is inconvenient because it is necessary to separate the upper lid and the lower lid from the body in order to fold the body.

In addition, a conventional folding packaging box (Korean Patent Application No. 10-2015-0011668) has a problem that it is inconvenient because, when the box has no item stored therein or is carried around without any item stored therein, side parts need to be folded toward a bottom member with an upper lid member being opened in order to reduce the volume of the box.

In addition, a conventional folding box (Korean Patent No. 10-1996188) has a problem that it is vulnerable in protecting an item stored in the inside of the foldable box from an external impact, etc., because a flexible side portion made of a soft material is configured below a side part.

Related Documents

PATENT DOCUMENTS (Patent Document 1) Korean Patent No. 10-1179611 (Published on Sep. 4, 2012)

(Patent Document 2) Korean Patent Application Publication No. 10-2015-0011668 (Published on Feb. 2, 2015)

(Patent Document 3) Korean Patent No. 10-1996188 (Published on Jul. 8, 2019)

BRIEF SUMMARY OF THE INVENTION

The present disclosure provides a foldable box having a left part and a right part, the left and right parts which include a pair of left auxiliary plates and a pair of right auxiliary plates, respectively, and most of which is made of a hard material, so that it is possible to protect an item stored therein from an external impact and easily fold or unfold the foldable box, thereby maximizing convenience of storage and use.

According to a first embodiment of the present disclosure, there is provided a foldable box including a bottom part comprising a pair of bottom plates folded inward by one or more bottom folding means, a front part connected to a front side of the bottom part, a rear part connected to a rear side of the bottom part, a left part connected to a left side of the bottom part and including a pair of left plates to be folded inward by one or more left folding means, and a right part connected to a right side of the bottom part and including a pair of right plates to be folded inward by the one or more right folding means. The left part may include a pair of left auxiliary plates provided adjacent to be folded inward when the pair of the left plates are folded inward. Lower sides of the pair of left auxiliary plates may be connected to left sides of the pair of the bottom plates by a left variable folding means, and left and right sides of the pair of left auxiliary plates may be connected to the pair of left plates by a pair of left auxiliary folding means. The right part may include a pair of right auxiliary plates provided adjacent to be folded inward when the pair of right plates are folded inward. Lower sides of the pair of right auxiliary plates may be connected to right sides of the pair of the bottom plates by a right variable folding means, and left and right sides of the pair of right auxiliary plates may be connected to the pair of the right plates by a pair of right auxiliary folding means. The pair of the left auxiliary plates and the pair of the right auxiliary plates may be folded inward by the left variable folding means, the right variable folding means, the pair of the left auxiliary folding means, and the pair of the right auxiliary folding means when the bottom part, the left part, and the right part are folded inward.

According to the first embodiment of the present disclosure, the left variable folding means and the right variable folding means may be made of a soft material with a predetermined area so as not to be interfered with a path along which the bottom part is raised and folded inward when the pair of the left auxiliary plates and the pair of the right auxiliary plates are folded inward.

According to the first embodiment of the present disclosure, A first cover extending from the lower sides of the pair of the left auxiliary plates and the pair of the right auxiliary plates may be provided in the pair of the left auxiliary plates and the pair of the right auxiliary plates to cover the left variable folding means and the right variable folding means.

According to the first embodiment of the present disclosure, the pair of the left auxiliary folding means and the pair of the right auxiliary folding means may be made of a soft material with a predetermined area so as not to be interfered with a path along which the pair of the left plates and the pair of the right plates are folded inward when the pair of the left auxiliary plates and the pair of the right auxiliary plates are raised and folded inward in response to the bottom part being raised and folded inward.

According to the first embodiment of the present disclosure, a second cover extending from left sides and right sides of the left and right auxiliary plates, respectively, may be provided in the pair of the left auxiliary plates and the pair of the right auxiliary plates to cover the pair of the left auxiliary folding means and the pair of the right auxiliary folding means.

According to the first embodiment of the present disclosure, a left connection folding means made of a soft material with a predetermined area may be provided between the pair of left auxiliary plates, so that the pair of the left auxiliary plates are allowed to be folded inward with surrounding the pair of the bottom plates when the pair of the bottom plates are raised and folded inward. A right connection folding means made of a soft material with a predetermined area may be provided between the pair of the right auxiliary plates, so that the pair of the right auxiliary plates are allowed to be folded inward with surrounding the pair of the bottom plates when the pair of the bottom plates are raised and folded inward.

According to the first embodiment of the present disclosure, a third cover extending from the pair of the left auxiliary plates and the pair of the right auxiliary plates toward the left connection folding means and the right connection folding means, respectively, may be provided in the pair of the left auxiliary plates and the pair of the right auxiliary plates to cover the left connection folding means and the right connection folding means.

According to the first embodiment of the present disclosure, the left variable folding means may include a left guide portion provided in each inner surface of the pair of the left auxiliary plates with a predetermined length, and a left sliding portion provided in each of the left sides of the pair of the bottom plates to be slidable while fastened to the left guide portion so as to guide a path of the pair of the bottom plates to be raised and folded inward along the left guide portion and a path of the pair of the left auxiliary plates to be folded inward. The right variable folding means may include a right guide portion provided in each inner surface of the pair of the right auxiliary plates with a predetermined length to guide a path of the pair of the bottom plates to be raised and folded inward, and a right sliding portion provided in each of the right sides of the pair of the bottom plates to be slidable while fastened to the right guide portion so as to guide a path of the pair of the bottom plates to be raised and folded inward along the right guide portion and a path of the right auxiliary plate to be folded inward.

According to the first embodiment of the present disclosure, the pair of the left auxiliary folding means may include a first left fastening portion and a second left fastening portion that are respectively formed in the pair of the left auxiliary plates and the pair of the left plates and engaged with each other, so that the pair of the left auxiliary plates and the pair of the left plates are folded inward when the pair of the bottom plates are raised and folded inward. The pair of the right auxiliary folding means may include a first right fastening portion and a second right fastening portion that are respectively formed in the pair of the right auxiliary plate and the pair of the right plates and engaged with each other, so that the pair of the right auxiliary plate and the pair of the right plates are folded inward when the pair of the bottom plates are raised and folded inward.

According to the first embodiment of the present disclosure, a left hinge magnet and a right hinge magnet may be respectively provided in the one or more left folding means and the one or more right folding means to increase a fixing force in a state in which the left part and the right part are unfolded.

According to the first embodiment of the present disclosure, an elastic body may be provided in the bottom part to provide elasticity to the one or more bottom folding means and the pair of the bottom plates when the pair of the bottom plates are folded inward.

According to the first embodiment of the present disclosure, the foldable box may further include a box lid for covering or opening an open upper side of the foldable box.

According to a second embodiment of the present disclosure, there is provided a foldable box including a bottom part comprising a pair of bottom plates folded inward by one or more bottom folding means, an upper part positioned at an upper side of the bottom part and comprising a pair of upper plates to be folded inward by one or more upper folding means, a left part connected to a left side of the bottom part and including a pair of left plates to be folded inward by the one or more left folding means, and a right part connected to a right side of the bottom part and including a pair of right plates to be folded inward by the one or more right folding means. The left part may include: a pair of first left auxiliary plates provided adjacent to be folded inward when the pair of the left plates are folded inward; and a pair of second left auxiliary plates provided adjacent to be folded inward when the pair of the left plates are folded inward. Lower sides of the pair of first left auxiliary plates may be connected to the left sides of the pair of the bottom plates by a left variable folding means, and left and right sides of the pair of first left auxiliary plates may be connected to the pair of the left plates by the pair of the left auxiliary folding means. Upper sides of the pair of second left auxiliary plates may be connected to the left sides of the pair of the upper plates by the left variable folding means, and left and right sides of the pair of second left auxiliary plate may be connected to the pair of the left plates by the pair of the left auxiliary folding means. The right part may include: a pair of first right auxiliary plates provided adjacent to be folded inward when the pair of the right plates are folded inward; and a pair of second right auxiliary plates provided adjacent to be folded inward when the pair of the right plates are folded inward. Lower sides of the pair of first right auxiliary plates may be connected to the right sides of the pair of the bottom plates by a right variable folding means, and left and right sides of the pair of first right auxiliary plates may be connected to the pair of the right plates by the pair of the right auxiliary folding means. Upper sides of the pair of second right auxiliary plates may be connected to the right sides of the pair of the upper plates by the right variable folding means, and left and right sides of the pair of second right auxiliary plates may be connected to the pair of the right plates by the pair of the right auxiliary folding means. The pair of the first left auxiliary plates, the pair of the first right auxiliary plates, the pair of the second left auxiliary plates, and the pair of the second right auxiliary plates may be folded inward by the left variable folding means, the right variable folding means, the pair of the left auxiliary folding means, and the pair of the right auxiliary folding means when the bottom part, the upper part, the left part, and the right part are folded inward.

The front part located at a front side of the bottom part or the rear part located at a rear side of the bottom part may be open at a portion.

In the foldable box according to the second embodiment of the present disclosure, an opening cover for covering or opening the opened portion of the front or rear part may further include.

According to the second embodiment of the present disclosure, the foldable box may further include one or more rear wheels provided below the rear part to move the foldable box.

According to the second embodiment of the present disclosure, the foldable box may further include one or more front wheels provided below the front part to move the foldable box.

According to the second embodiment of the present disclosure, the foldable box may further include a handle provided in the rear part to allow a user to carry the foldable box.

DETAILED DESCRIPTION OF THE INVENTION

Figure 1:
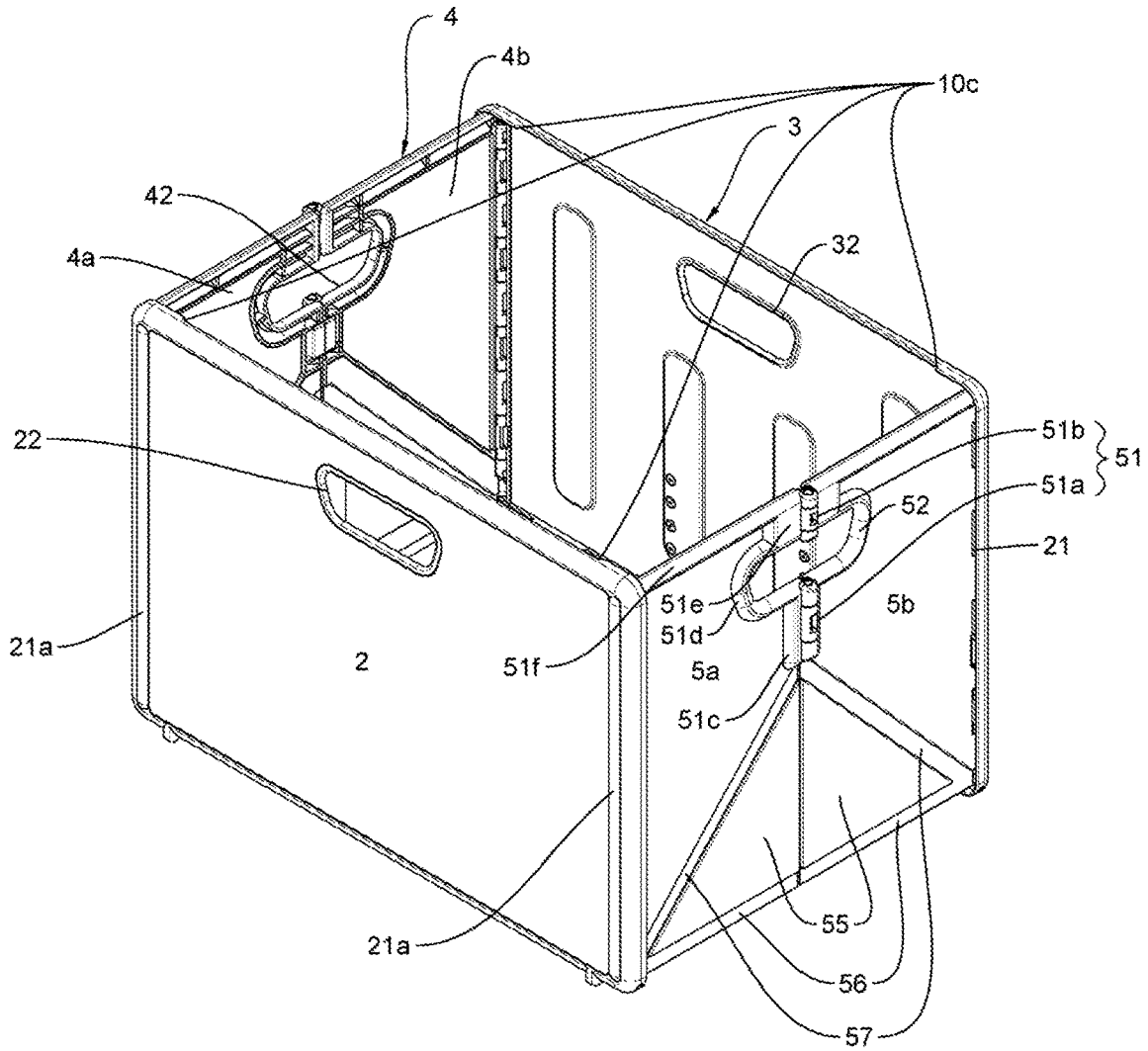
FIGS. 1 to 3 are perspective views illustrating a foldable box according to a first embodiment of the present disclosure.

Hereinafter, when it is determined that a detailed description on a well-known technology makes the subject matter of the present disclosure unnecessarily obscure, the detailed description will be omitted. Further, numerals used in the process of describing the present specification are only identification numbers to distinguish one element from another element.

Further, it should be noted that the terms used in the present specification and the claims are not to be limited to their lexical meanings, but are to be interpreted to conform with the technical idea of the present invention under the principle that the inventor can properly define the terms for the best description of the invention made by the inventor.

Therefore, the embodiments and the constitution illustrated in the attached drawings are merely preferable embodiments according to the present invention, and thus they do not express all of the technical idea of the present invention, so that it should be understood that various equivalents and modifications can exist which can replace the embodiments described in the time of the application.

Preferred embodiments of the present disclosure will be described in more detail, but the well-known technical features will be omitted or described briefly for brevity of description.

Description of Foldable Box According to First Embodiment

Referring to FIGS. 1 to 5, a foldable box according to a first embodiment of the present disclosure may include a bottom part 1 including a pair of bottom plates 1*a* and 1*b* to be folded inward by one or more bottom folding means 11, a front part 2 connected to a front of the bottom part 1, a rear part 3 connected to a rear of the bottom part 1, a left side 4 connected to a left side of the bottom part 1 and including a pair of left plates 4*a* and 4*b* to be folded inward by one or more left folding means 41, a right side 5 connected to a right side of the bottom part 1 and including a pair of right plates 5*a* and 5*b* to be folded inward by one or more right folding means 51. The left side 4 may include a pair of left auxiliary plates 45, and the pair of left auxiliary plates 45 may have lower sides respectively connected to left sides of the pair of bottom plates 1*a* and 1*b* by a left variable folding means 46, and left and right sides respectively connected to the pair of left plates 4*a* and 4*b* by a pair of left auxiliary folding means 47, so that the pair of left auxiliary plates 45 are provided adjacent to each other to be folded inward when the left plates 4*a* and 4*b* are folded inward. The right side 5 may include a pair of right auxiliary plates 55, and the pair of right auxiliary plates 55 may have lower sides respectively connected to right sides of the pair of bottom plates 1*a* and 1*b* by the right variable folding means 56, and left and right sides respectively connected to the pair of right plates 5*a* and 5*b* by a pair of right auxiliary folding means 57 so that the pair of right auxiliary plates 55 are provided adjacent to each other to be folded inward when the right plates 5*a* and 5*b* are folded inward. The left auxiliary plate 45 and the right auxiliary plate 55 may be configured to be folded inward by the left variable folding means 46, the right variable folding means 56, the pair of the left auxiliary folding means 47, and the pair of the right auxiliary folding means 57 when the bottom part 1, the left side 4, and the right side 5 are folded inward.

Figure 2:
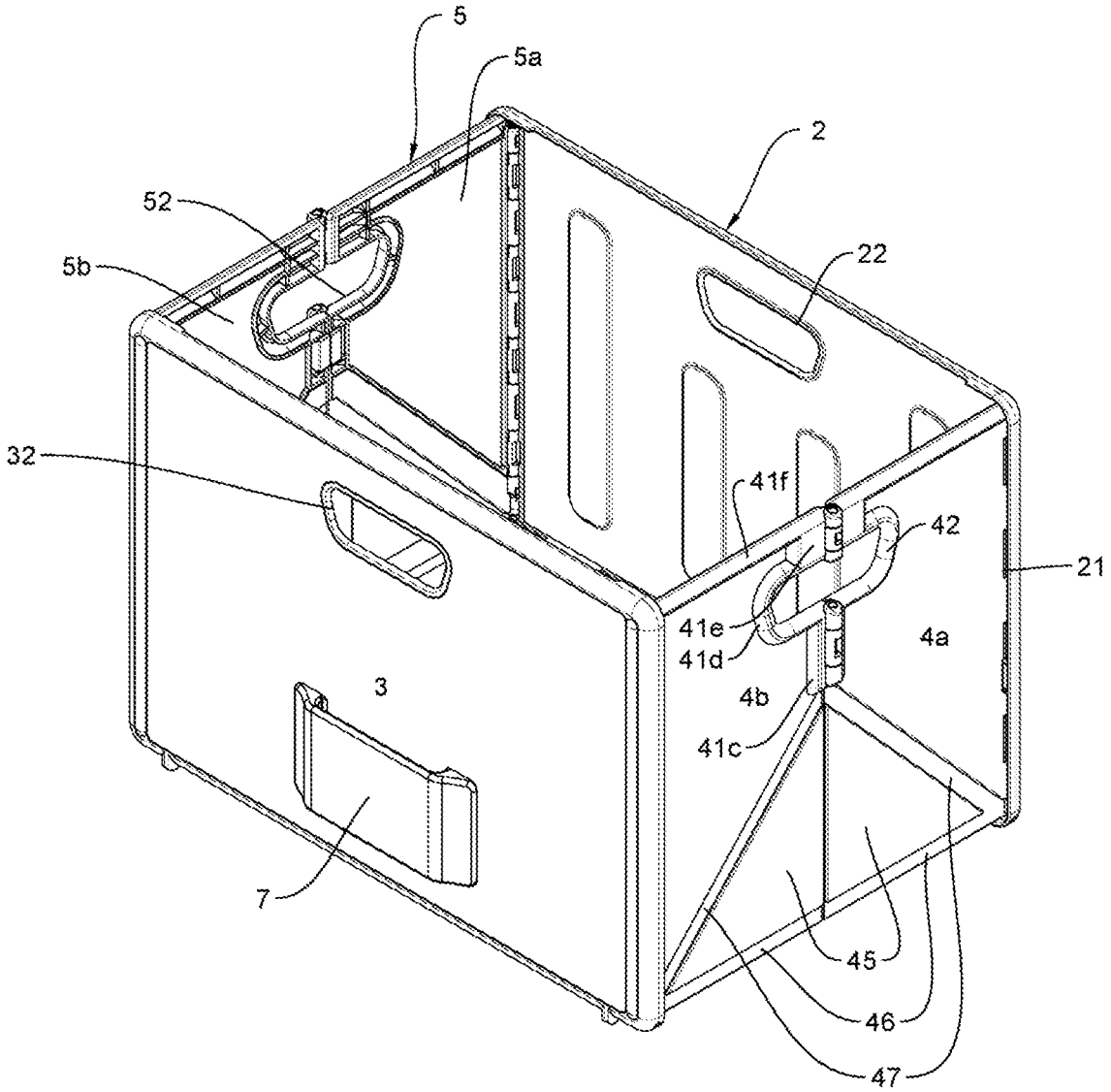
Figure 3:
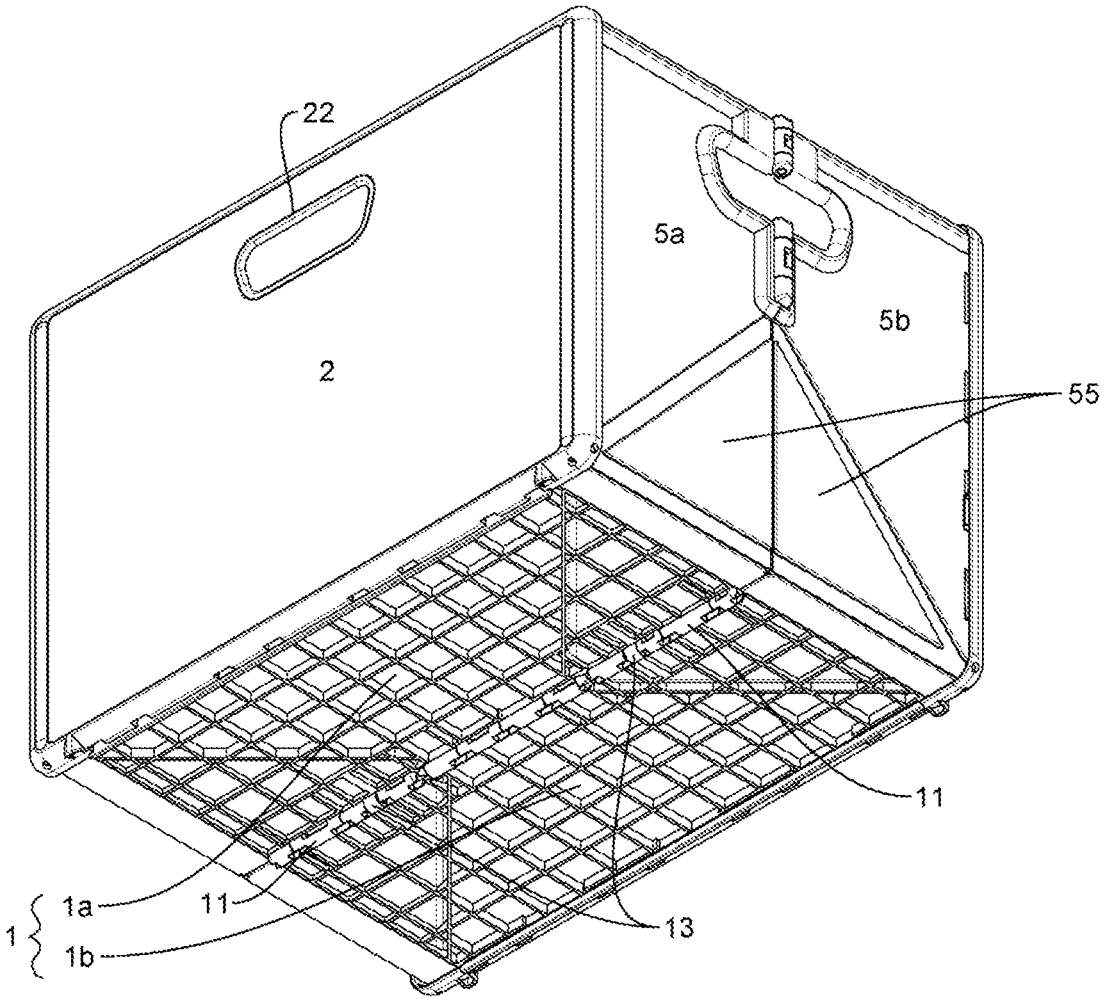

Referring to FIGS. 1 and 2, the foldable box of the present disclosure may be provided in the form of a hard rectangular parallelepiped, of which an upper side may be opened, so that an item may be stored inside. In addition, in order to protect an item stored inside, the foldable box of the present disclosure may be made of a synthetic resin such as Poly Propylene (PP), Poly Carbonate (PC) and Acrylonitrile Butadiene Styrene (ABS) copolymer or may be made of a hard material such as corrugated paper, a hard board, and the like.

In addition, like the left part 4 and the right part 5, the left auxiliary plates 45 and the right auxiliary plates 55 may be made of synthetic resin or made of a hard material such as corrugated cardboard to protect an item stored in the inside of the foldable box from an external impact, etc.

The pair of bottom plates 1*a* and 1*b* may be configured to be folded only inward without being folded outwardly of the foldable box, and the pair of left plates 4*a* and 4*b* and the pair of right plates 5*a* and 5*b* may be also preferably configured to be only folded inward without being folded outwardly of the foldable box.

Figure 12:
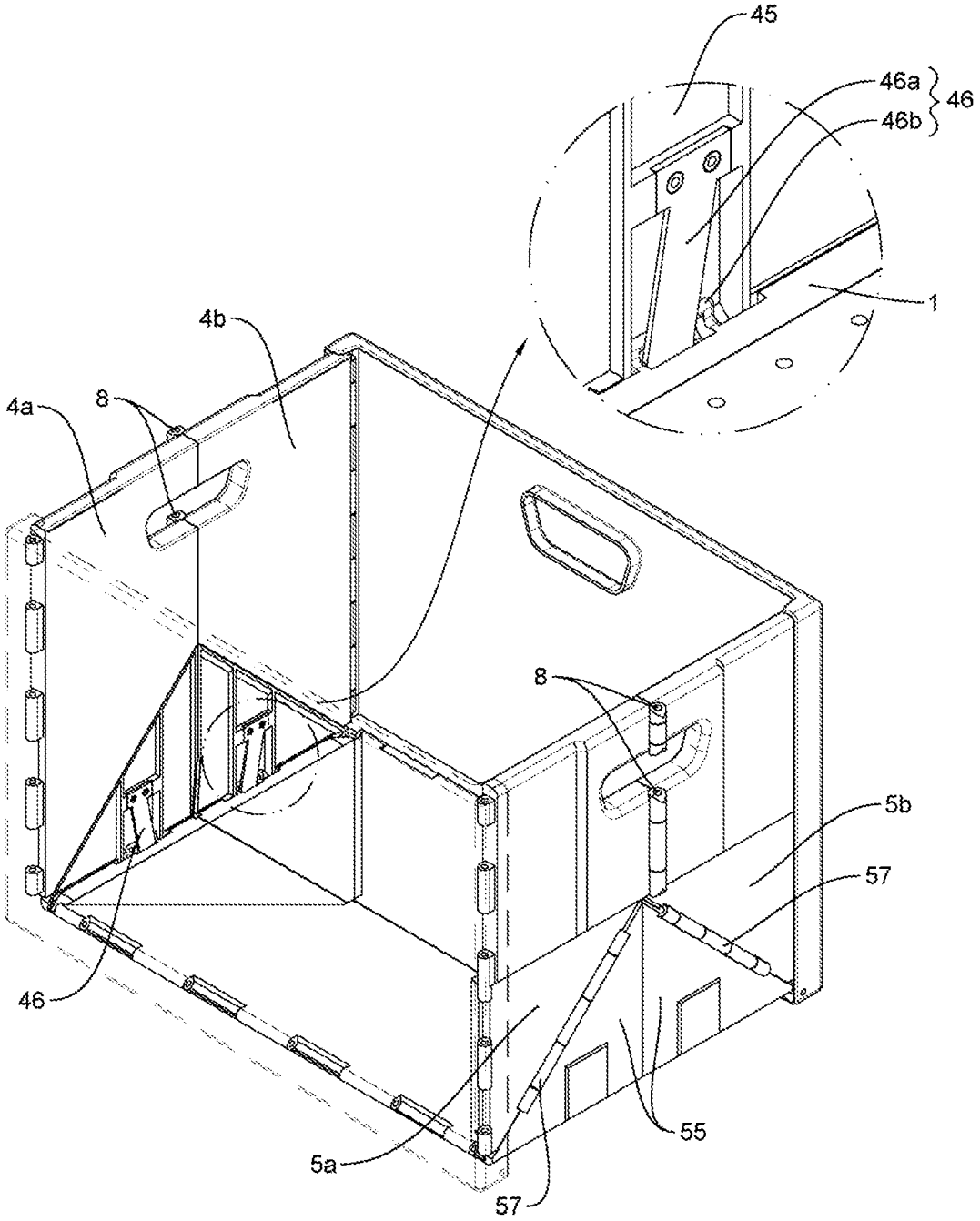
FIG. 12 is a perspective view of the foldable box according to the first embodiment of the present disclosure.
Figure 13:
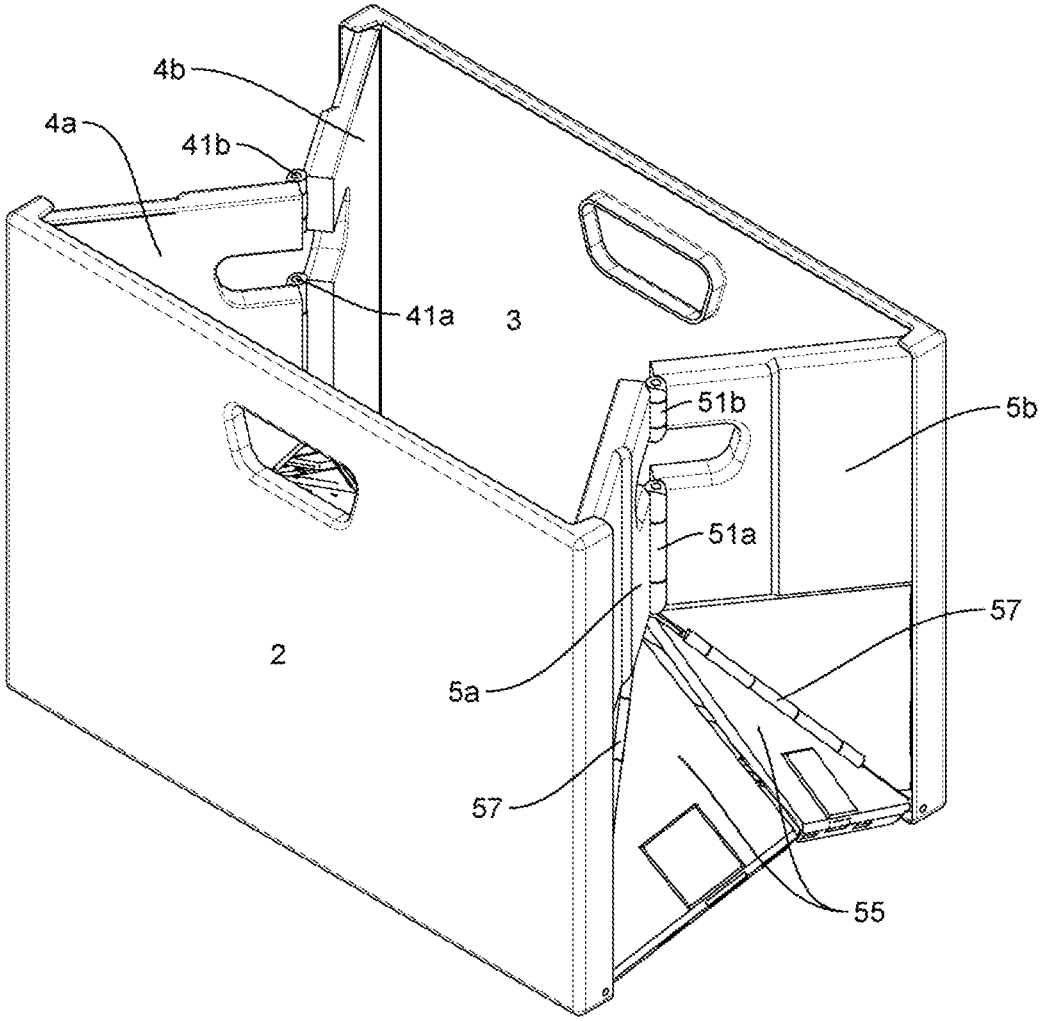
FIGS. 13 and 14 are perspective views illustrating a folding method of the foldable box according to the first embodiment of the present disclosure.
Figure 21:
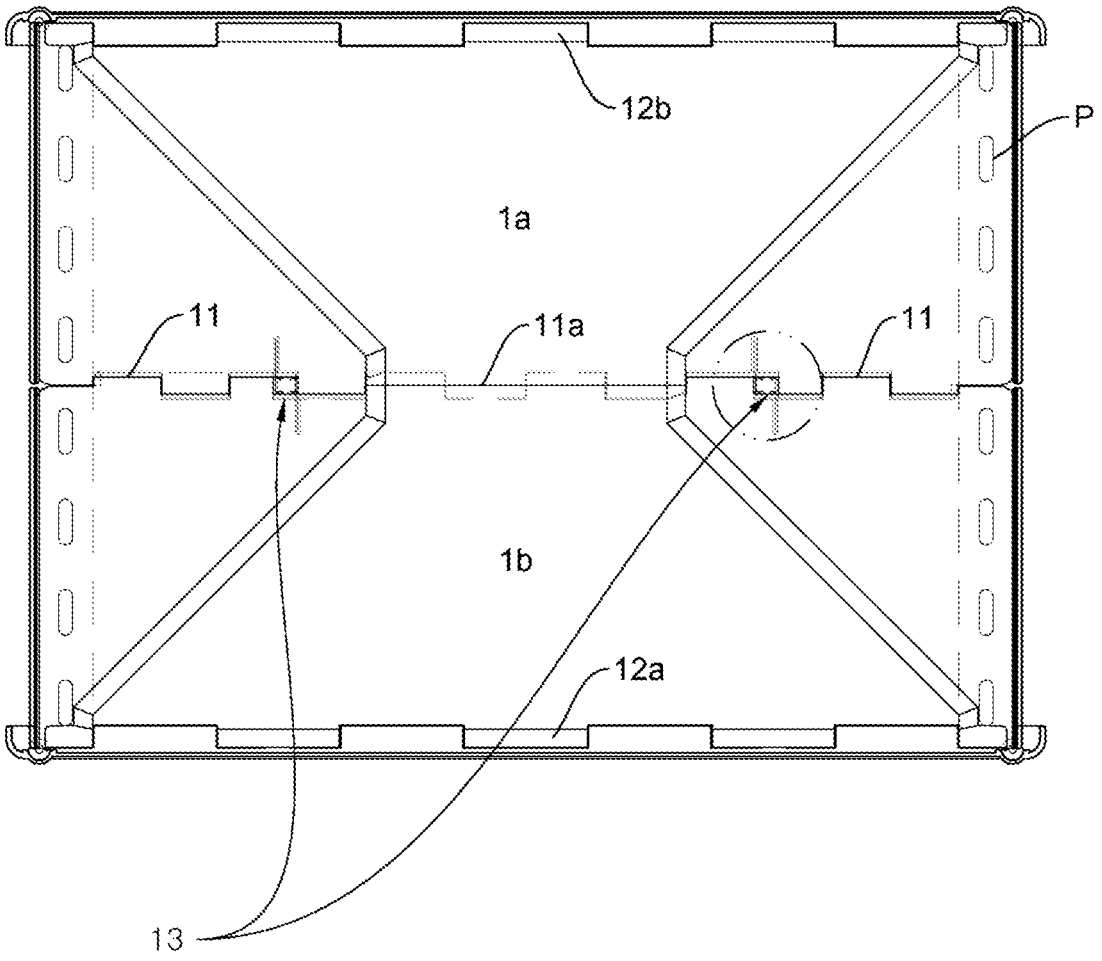
FIG. 21 is a plan view of the foldable box according to the first embodiment of the present disclosure.
Figure 22:
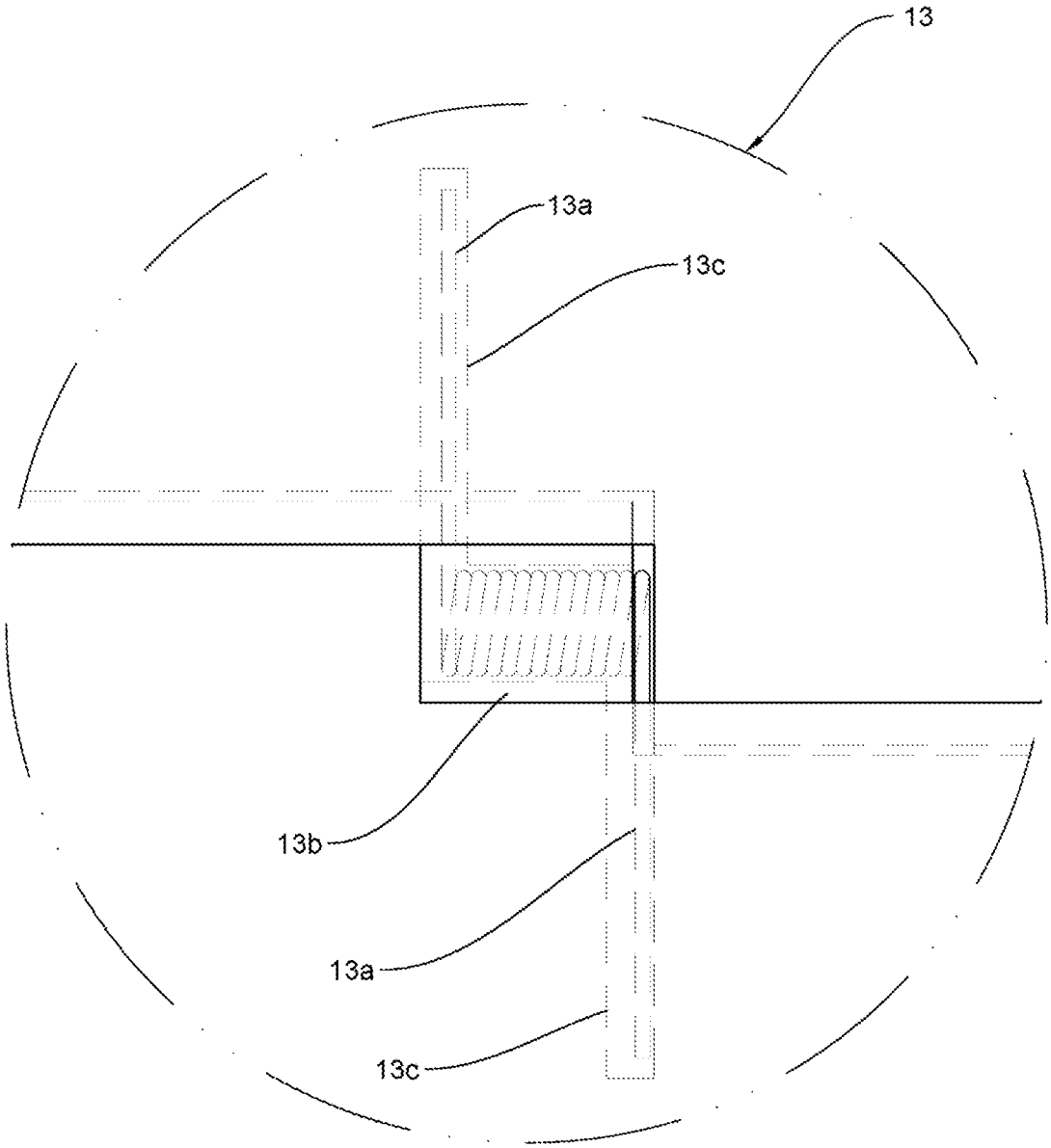
FIGS. 22 and 23 illustrate an elastic body of the foldable box according to the first embodiment of the present disclosure.
Figure 23:
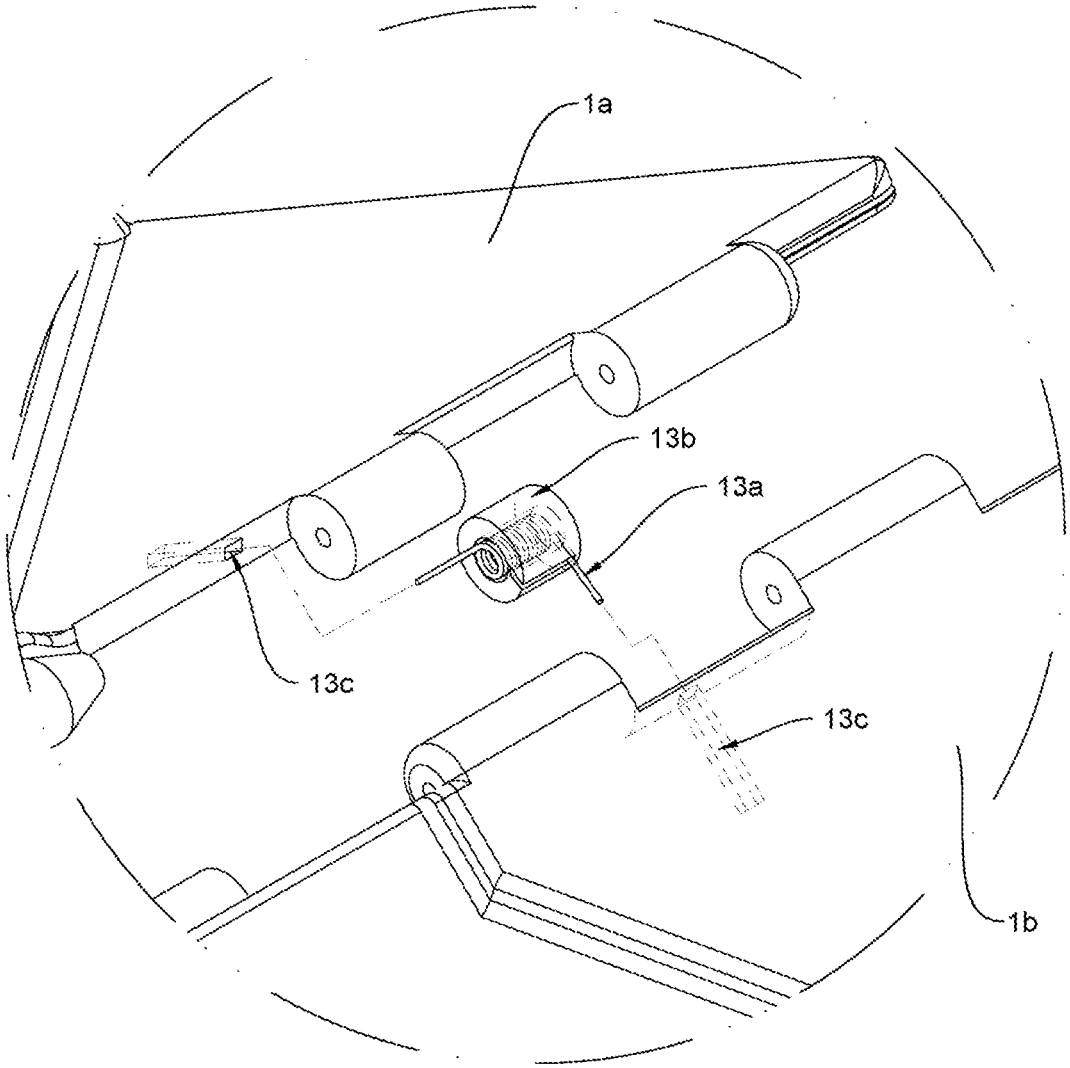

Referring to FIGS. 12 and 21, according to the present disclosure, a bottom folding means 11, the left folding means 41, and the right folding means 51 may be provided as foldable types or hinges. Thus, when the bottom folding means 11, the left folding means 41 and the right folding means 51 are provided as hinges, a hinge rod 8 may be inserted therein.

Here, a foldable type refers to a type processed such that spacing between two members (a pair of bottom plates, etc.) is connected with a flexible material to fold the two member inward or may refer to a type processed such that a folding means inside a single member (the bottom part, etc.) is changed in thickness, density, volume, etc. to fold the single member inward.

In addition, according to the present disclosure, the bottom folding means 11, the left folding means 41, and the right folding means 51 may be each provided in two or more. In this case, it is preferable that the bottom plates 1*a* and 1*b*, the left plates 4*a* and 4*b*, and the right plates 5*a* and 5*b* are each provided as two or more pairs to correspond to the bottom folding means 11, the left folding means 41, and the right folding means 51. Accordingly, the foldable box may be made long in the front and rear length, and thus, more items may be stored therein.

For example, when the bottom folding means 11, the left folding means 41, and the right folding means 51 are provided in n number, the bottom plates 1*a* and 1*b*, the left plates 4*a* and 4*b*, and the right plates 5*a* and 5*b* may be provided as 2×n number. In this case, spacing to the adjacent bottom part 1, spacing to the left side 4, and spacing to the right part 5 may be connected by another folding means.

In addition, referring to FIG. 21, the bottom part 1 and the front part 2 may be vertically connected through a first connecting part 12*a*, and the bottom part 1 and the rear part 3 may be vertically connected through a second connecting part 12*b*, thereby enabling the bottom part 1 to be folded inward or unfolded.

Here, the first connecting part 12*a* and the second connecting part 12*b* may be provided as a foldable type or a hinge as the bottom folding means 11, the left folding means 41, and the right folding means 51 do.

Then, the front part 2 and the left part 4, the front part 2 and the right part 5, the rear part 3 and the left part 4, and the rear part 3 and the right part 5 may be vertically connected through edge connecting parts 21, respectively, so that the left part 4 and the right part 5 may be folded or unfolded inward.

Each edge connecting parts 21 may be provided as a foldable type or a hinge as the bottom folding means 11, the left folding means 41 and the right folding means 51 do.

In addition, when the edge connecting part 21 is provided as a hinge, an edge cover may be provided to surround the edge connecting part 21 in a direction toward the front or the rear of the edge connecting part 21 and be coupled to the edge connecting part 21, so that the edge cover 21*a* may improve impact strength while protecting the edge connecting part 21.

In addition, a front handle 22 and a rear handle 32 may be formed in one sides of the front part 2 and the rear part 3, respectively.

In addition, a left handle 42 and a right handle 52 may be formed in the left part 4 and the right part 5, respectively. Therefore, the foldable box of the present disclosure may be easily carried.

In addition, a left handle reinforcing portion 41*d* and a right handle reinforcing portion 51*d* may be provided at peripheries of the left handle 42 and the right handle 52, respectively, to increase the impact strength while protecting the left handle 42 and the right handle 52.

In addition, an engaging ring 7 may be provided in one side of the rear part 3. Using such an engaging ring 7 can be easily moved by coupling the foldable box of the present disclosure to a cart or hand truck.

Meanwhile, according to the present disclosure, a left hinge magnet 43 and a right hinge magnet 53 may be respectively provided in the left folding means 41 and the right folding means 51 to increase a fixing force in a state in which the left part 4 and the right part 5.

Specifically, it is preferable that the left hinge magnet 43 is provided as a pair of magnets of opposite polarities on both sides of the left folding means 41 so that an attractive force (a force to pull each other) may occur when the foldable box is unfolded. Likewise, it is preferable that the right hinge magnet 53 is also provided as a pair of magnets of opposite polarities on both sides of the right folding means 51 so that an attractive force may occur when the foldable box is unfolded.

In the present disclosure, the left part 4 and the right part 5 are configured to be folded inward when a user presses the left folding means 41 and the right folding means inward from the outside with a predetermined force.

That is, the left part 4 and the right part 5 are configured not to be easily folded inward by an attracting force, generated by the left hinge magnet 43 and the right hinge magnet 53, unless the user applies a predetermined force inward. In doing so, it is possible to easily maintain the unfolded state of the foldable box, thereby increasing convenience of use.

The left folding means 41 may include a first left hinge 41*a* and a second left hinge 41*b*. Specifically, the first left hinge 41*a* may be positioned below the left handle 42, and the second left hinge 41*b* may be positioned above the left handle 42.

In addition, the first left hinge 41*a* or the second left hinge 41*b* is provided with a left hinge magnet 43 so that a fixing force between the pair of left plates 4*a* and 4*b* may be increased in a state in which the left part 4 is unfolded.

In addition, a first left hinge reinforcing portion 41*c* and a second left hinge reinforcing portion 41*e* may be provided in the surroundings of the first left hinge 41*a* and the second left hinge 41*b* to increase the impact strength while protecting the first left hinge 41*a* and the second left hinge 41*b*.

Meanwhile, the pair of the left plates 4*a* and 4*b* may be composed of a first left plate 4*a* and a second left plate 4*b*, and the pair of the right plates 5*a* and 5*b* may include a first right plate 5*a* and a second right plate 5*b*. Likewise, the pair of the bottom plates 1*a* and 1*b* may be composed of a first bottom plate 1*a* and a second bottom plate 1*b*.

In addition, a left edge reinforcing portion 41*f* may be provided at upper ends of the first left plate 4*a* and the second left plate 4*b* to protect the first left plate 4*a* and the second left plate 4*b* when holding the left handle 42 and increase impact strength.

The right folding means 51 may include a first right hinge 51*a* and a second right hinge 51*b*. Specifically, the first right hinge 51*a* may be positioned below the right handle 52, and the second right hinge 51*b* may be positioned above the right handle 52.

In addition, the first right hinge 51*a* or the second right hinge 51*b* may be provided with a right hinge magnet 53 so that a fixing force between the first right plate 5*a* and the second right plate may be increased in a state in which the right part 5 is unfolded.

In addition, a first right hinge reinforcing portion 51*c* and a second right hinge reinforcing portion 51*e* may be provided in the surroundings of the right left hinge 51*a* and the second right hinge 51*b* to increase impact strength while protecting the first right hinge 51*a* and the second right hinge 51*b*.

In addition, a right edge reinforcing portion 51*f* may be provided at upper ends of the first right plate 5*a* and the second right plate 5*b* to protect the pair of the right plates 5*a* and 5*b* when holding the right handle 52 and increase impact strength.

Referring to 22 and 23, in the foldable box according to the first embodiment of the present disclosure, an elastic body 13 may be provided in the bottom part 1 to provide elasticity to the bottom folding means 11 and the pair of the bottom plates 1*a* and 1*b* when the pair of the bottom plates 1*a* and 1*b* are folded inward.

That is, the elastic body 13 is provided to provide elasticity the bottom folding means 11 or the first connection part 12*a* or the second connection part 12*b* when the bottom part 1 is folded inward. To this end, the elastic body 13 may include a bottom hinge spring 13*a* and a spring case 13*b*.

Specifically, when the elastic body 13 is provided in the bottom part 1, the spring case 13*b* may be provided to surround the bottom hinge spring 13*a*. Therefore, the bottom hinge spring 13*a* may be protected by the spring case 13*b*. Meanwhile, as both ends of the bottom hinge spring 13*a* are respectively inserted into spring holes 13*c* formed in the first bottom plate 1*a* and the second bottom plate 1*b* or in the front part 2 and the rear part 3, elasticity may be provided to the bottom plates 1*a* and 1*b*. In addition, the bottom hinge springs 13*a* may be prevented from exposure to the outside and thereby protected.

Therefore, in the present disclosure, the bottom part 1 may be easily folded inward when the left part 4 and the right part 5 are folded inward, because a predetermined force for inward folding the bottom part 1 is generated due to the elasticity of the bottom hinge spring 13*a* in a state in which the bottom part 1 is unfolded.

In addition, a bottom reinforcing portion 11*b* may be provided in upper sides of the first bottom plate 1*a* and the second bottom plate 1*b* to increase impact strength while protecting the first bottom plate 1*a* and the second bottom plate 1*b*. That is, when the foldable box is in a folded state, the bottom reinforcing portion 11*b* is located in a space between the left part 4 and the right part 5. Thus, it is possible to maintain an overall thickness of the foldable box and increase the impact strength of the bottom part 1 using the bottom reinforcing portion 11*b*.

In addition, a bottom hinge step 11*a* may be provided in the bottom folding means 11 or the bottom reinforcing portion 11*b* to contact the bottom folding means 11. Therefore, when an item is stored in the foldable box while the bottom part 1 is unfolded, the pair of the bottom plates 1*a* and 1*b* may maintain a load of the item by a contact pressure of the hinge step 11*a* and a force by which the left auxiliary plates 45 and the right auxiliary plates 55 connected to the first bottom plate 1*a* and the second bottom plate 1*b* supports the bottom plates 1*a* and 1*b*. As a result, the bottom part 1 may maintain a horizontal state without being folded outward.

In addition, according to the present disclosure, the left auxiliary plates 45 and the right auxiliary plates 55 may be each provided in a triangular shape, respectively. As a result, the first left plate 4*a*, the second left plate 4*b*, the first right plate 5*a*, and the second right plate 5*b* may be provided in a trapezoidal shape.

Figure 4:
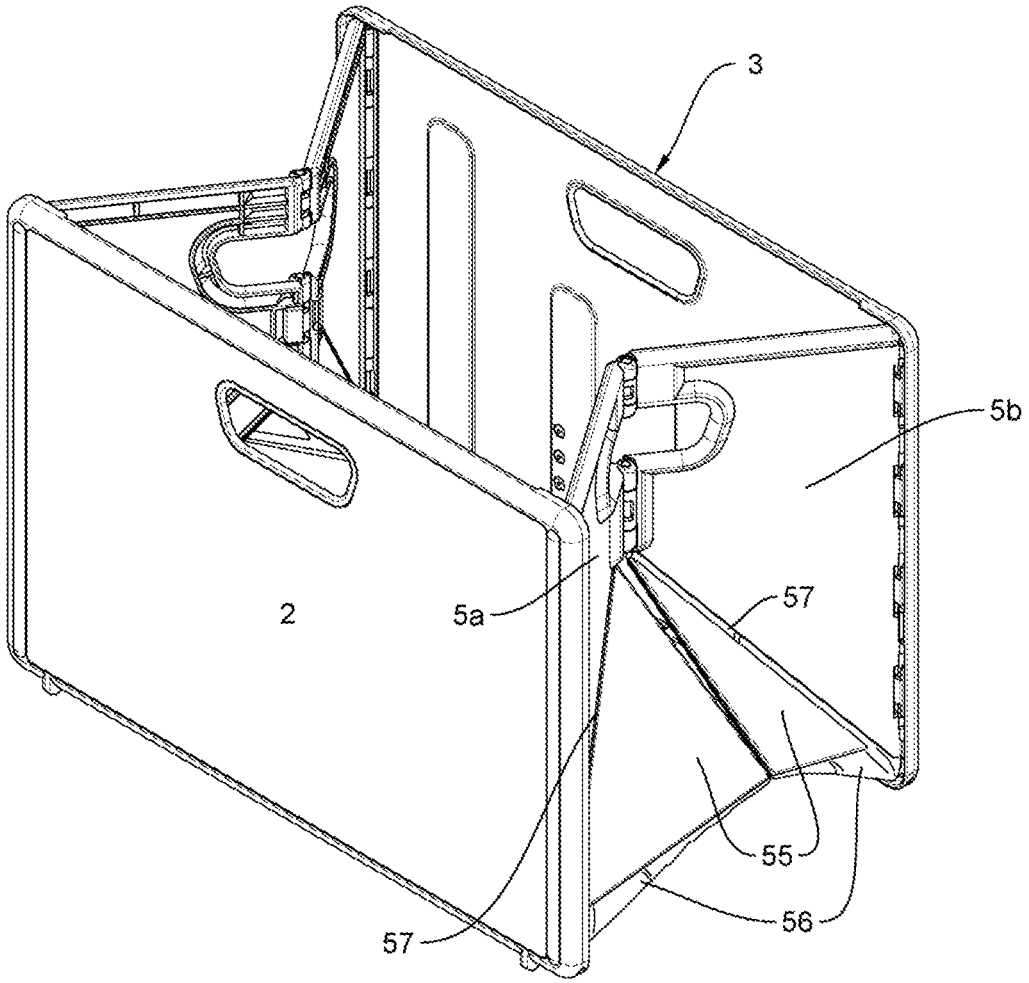
FIG. 4 is a perspective view illustrating a folding method of the foldable box according to the first embodiment of the present disclosure.
Figure 5:
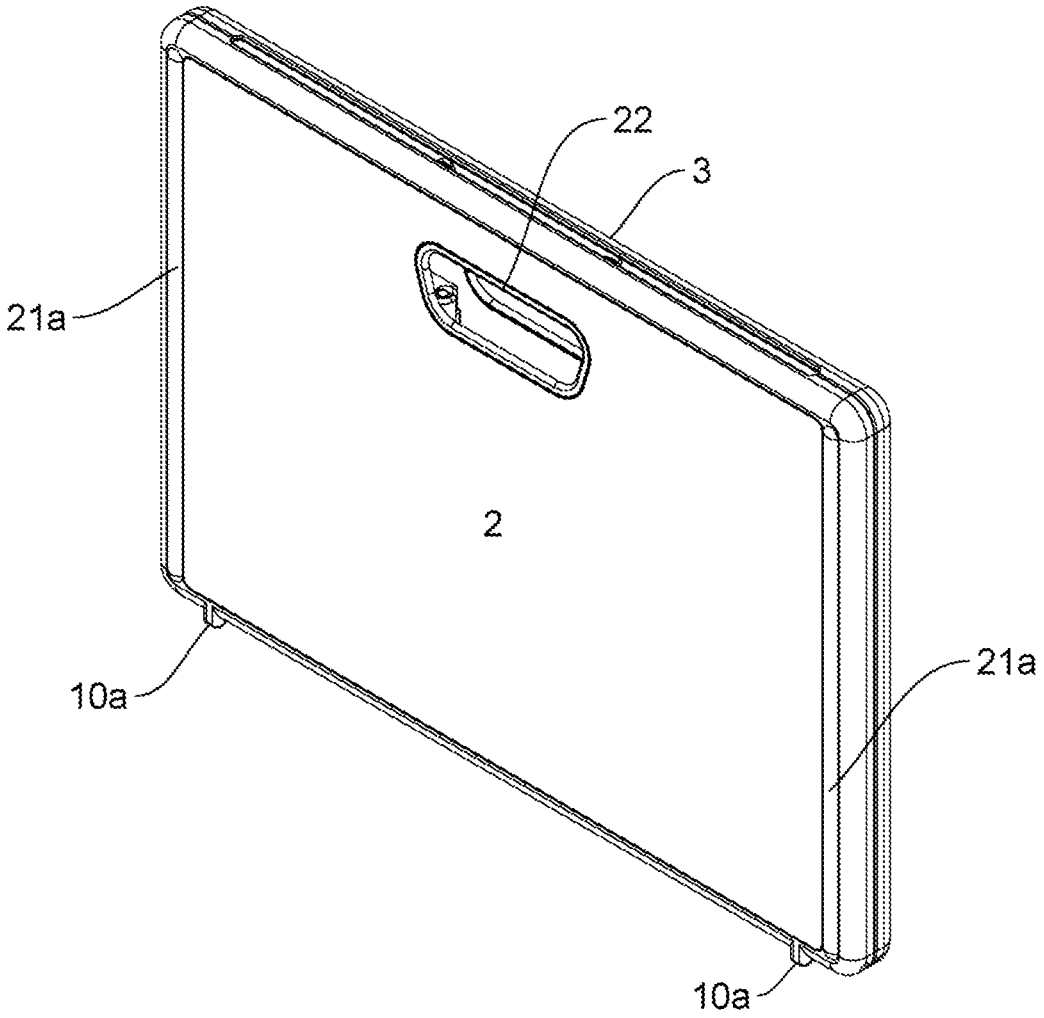
FIG. 5 is a perspective view illustrating a folded state of the foldable box according to the first embodiment of the present disclosure.

Referring to FIG. 4, in the foldable box according to the first embodiment of the present disclosure, the left variable folding means 46 and the right variable folding means 56 may be made of a soft material with a predetermined area so as not to be interfered with a path along which the bottom part 1 is raised and folded inward when the left auxiliary plates 45 and the right auxiliary plates 55 are folded inward.

That is, since the left variable folding means 46 and the right variable folding means 56 are made of a soft material with a predetermined area, a path along which the left auxiliary plates 45 and the right auxiliary plates 55 are raised and folded inward may not be interfered with a path along which the pair of the bottom plates 1*a* and 1*b* are raised and folded inward.

Figure 8A:
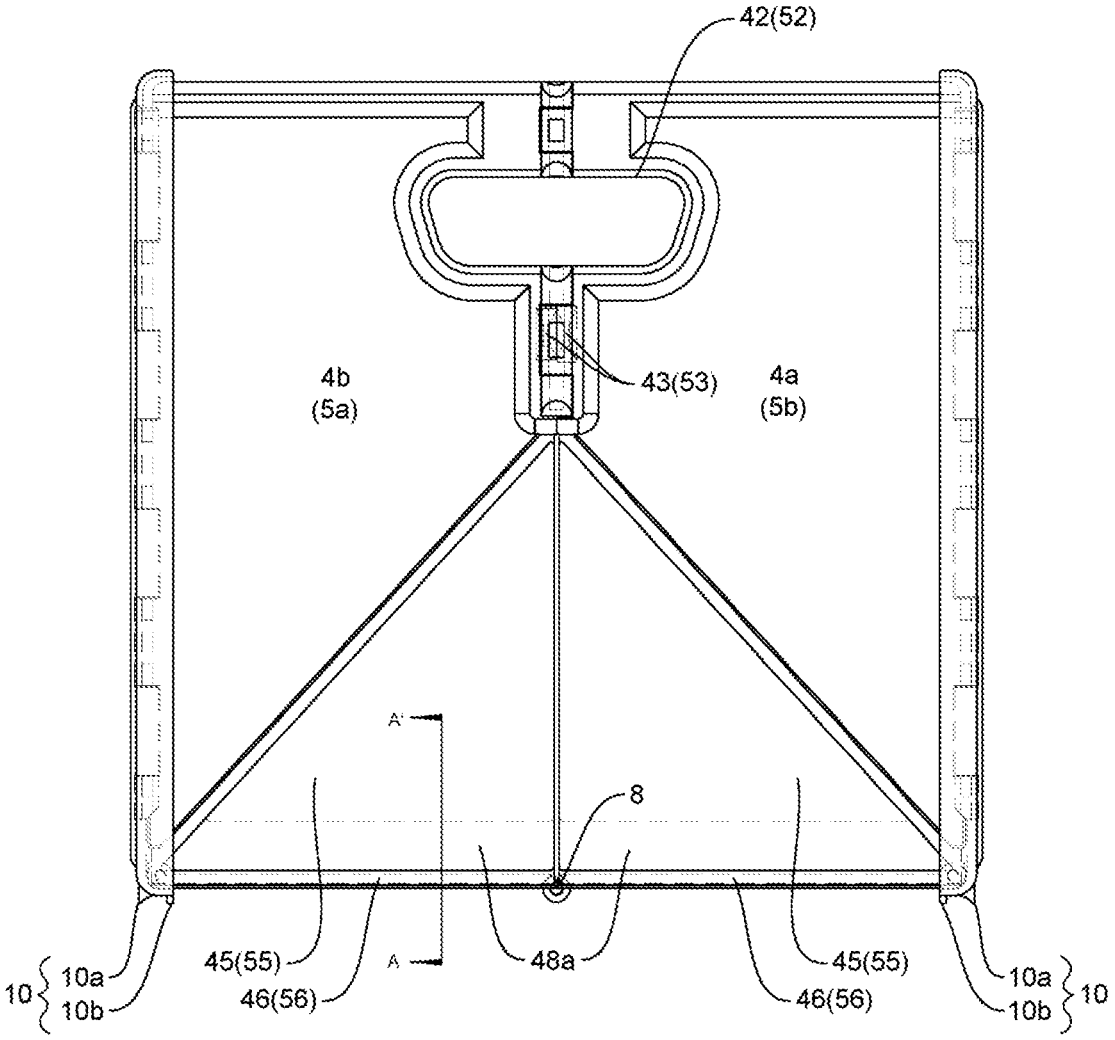
FIGS. 8A, 9A, and 10A are side views of the foldable box according to the first embodiment of the present disclosure.
Figure 8B:
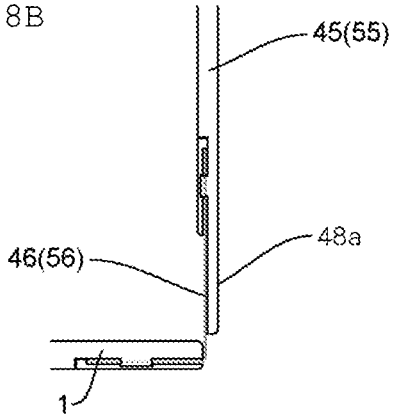
FIG. 8B is a cross sectional view taken along line A-A' shown in FIG. 8A.

Referring to FIG. 8, in the foldable box according to the first embodiment of the present disclosure, a first cover 48*a* extending from the lower sides of the left auxiliary plate 45 and the right auxiliary plate 55 may be provided in the left auxiliary plates 45 and the right auxiliary plates 55 to cover the left variable folding means 46 and the right variable folding means 56.

Therefore, the foldable box of the present disclosure may stably protect an item stored therein by the first cover 48*a* from an external impact.

Referring to FIG. 4, in the foldable box according to the first embodiment of the present disclosure, the left auxiliary folding means 47 and the right auxiliary folding means 57 may be made of a soft material with a predetermined area, so that the left auxiliary folding means 47 and the right auxiliary folding means 57 are not interfered with a path along which the left plates 4*a* and 4*b* and the right plates 5*a* and 5*b* are folded inward when the left auxiliary plates 45 and the right auxiliary plates 55 in response to the bottom part 1 being raised and folded inward.

That is, the left auxiliary plates 45 and the right auxiliary plates 55 may be raised along with the bottom plates 1*a* and 1*b* and folded inward without being interfered with a path along which the left plates 4*a* and 4*b* and the right plates 5*a* and 5*b* are folded inward when the bottom plates 1*a* and 1*b* are raised and folded inward by the left auxiliary folding means 47 and the right auxiliary folding means 57.

Figure 9A:
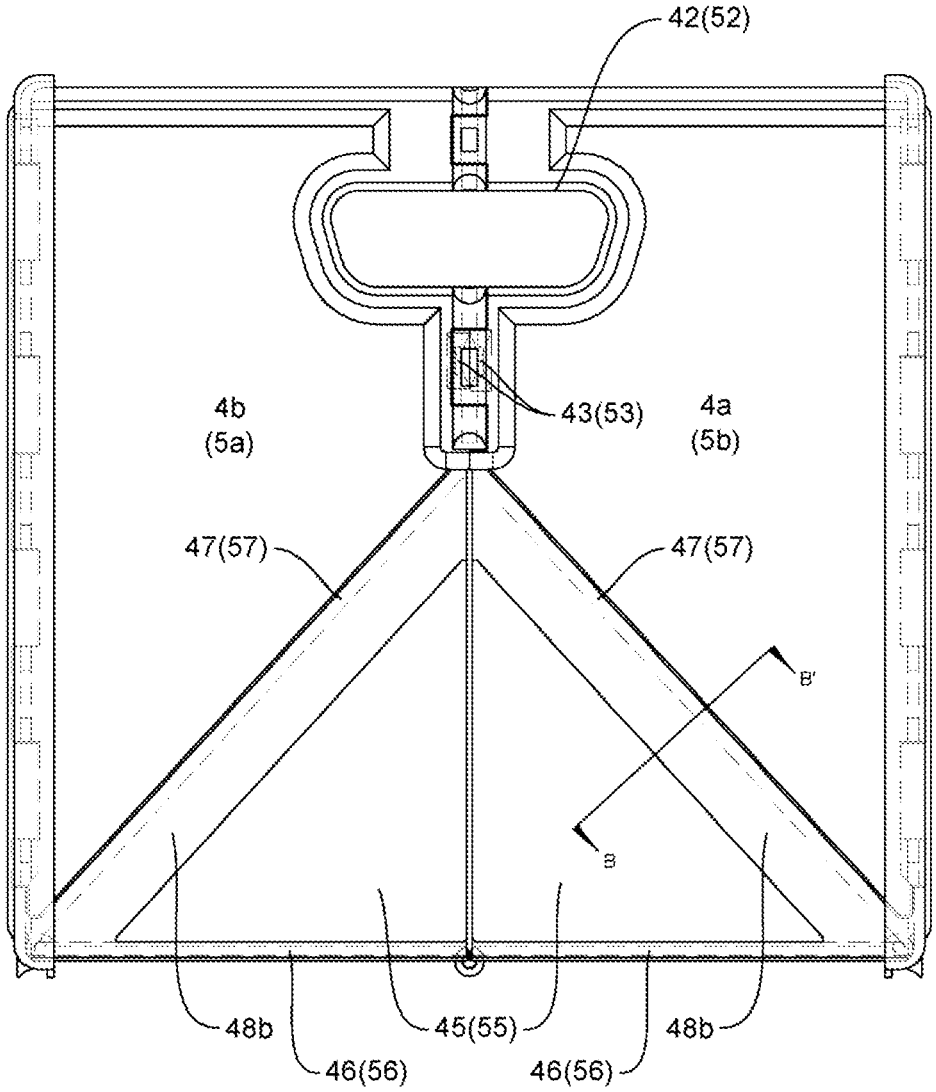
Figure 9B:
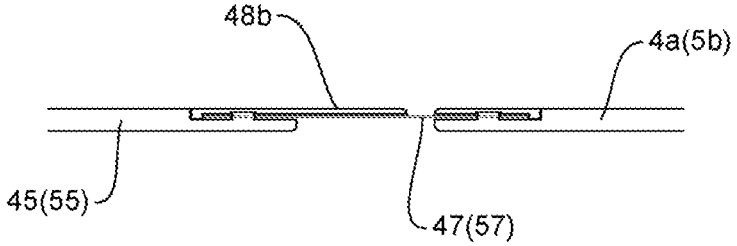
FIG. 9B is a cross sectional view taken along line B-B' shown in FIG. 9A.

Referring to FIG. 9, in the foldable box according to the first embodiment of the present disclosure, a second cover 48*b* extending from left and right sides of the left and right auxiliary plates 45 and 55, respectively, may be provided in the left auxiliary plates 45 and the right auxiliary plates 55 to cover the left auxiliary folding means 47 and the right auxiliary folding means 57.

Therefore, the foldable box of the present disclosure may stably protect an item stored therein from an external impact by using the second cover 48*b* in the same manner of using the first cover 48*a*.

Figure 10A:
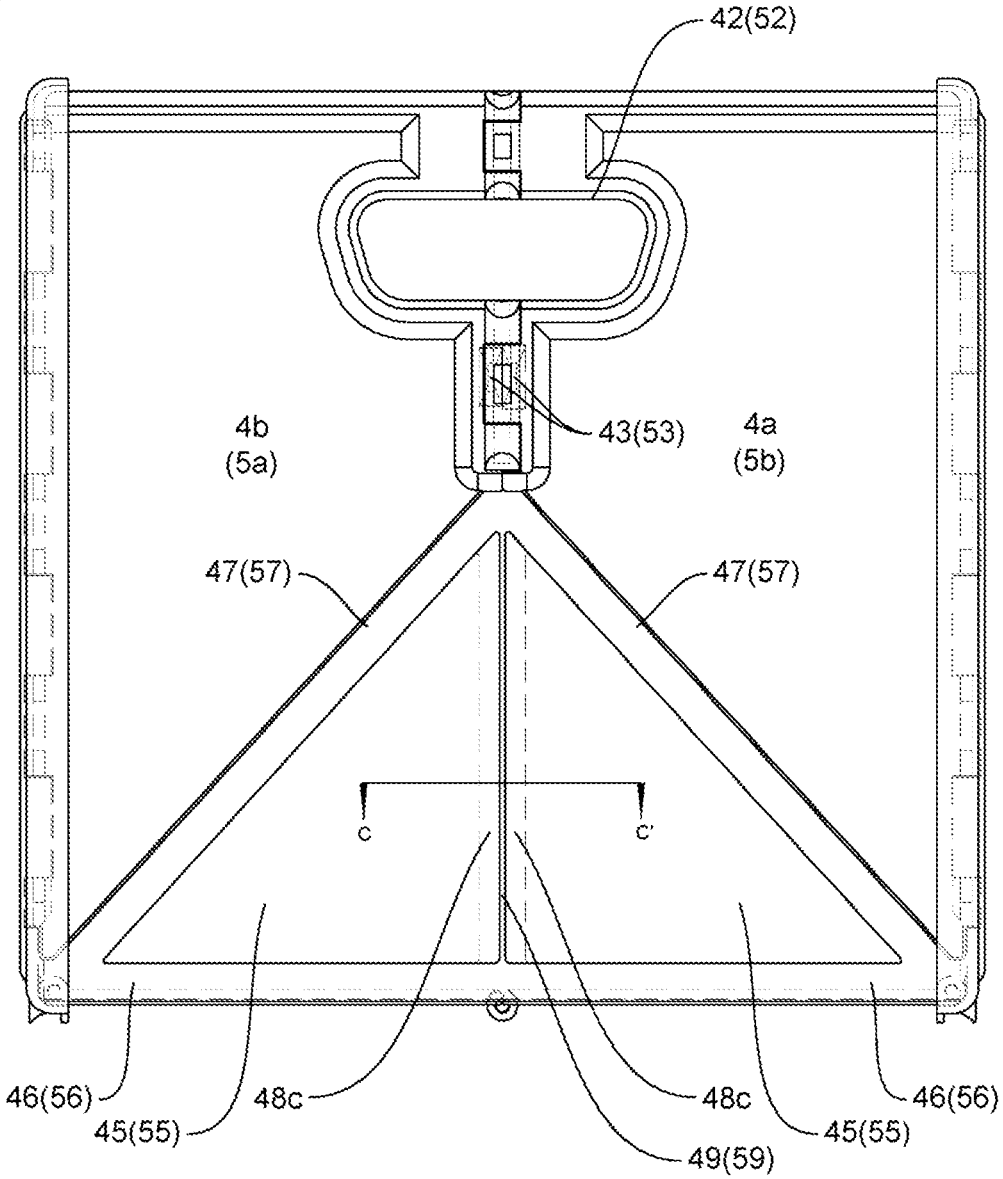
Figure 10B:
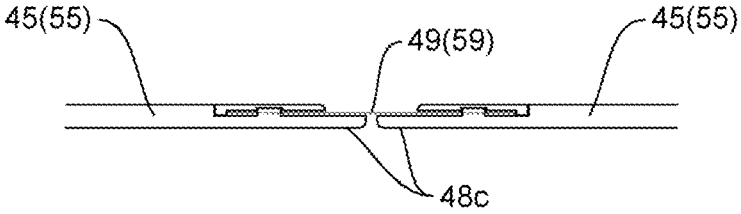
FIG. 10B is a cross sectional view taken along line C-C' shown in FIG. 10A.

Referring to FIG. 10, in the foldable box according to the first embodiment of the present disclosure, a left connection folding means 49 made of a soft material with a predetermined area may be provided between the pair of left auxiliary plates 45, and a right connection folding means 59 made of a soft material with a predetermined area may be provided between the pair of right auxiliary plates 55. When the pair of bottom plates 1*a* and 1*b* is raised and folded inward, the left connection folding means 49 may allow the pair of the left auxiliary plates 45 to be folded inward with surrounding the pair of the bottom plates 1*a* and 1*b*. When the pair of bottom plates 1*a* and 1*b* is raised and folded inward, the right connection folding means 59 may allow the pair of the right auxiliary plates 55 to be folded inward with surrounding the pair of the bottom plates 1*a* and 1*b*.

That is, the left auxiliary plates 45 and the right auxiliary plates 55 may be connected by the left connection folding means 49 and the right connection folding means 59, which are located between the left auxiliary plates 45 and the right auxiliary plates 55, so that an item stored inside is protected more stably when the foldable box is unfolded.

Referring to FIG. 10, in the foldable box according to the first embodiment of the present disclosure, a third cover 48*c* extending from the left auxiliary plates 45 and the right auxiliary plates 55 toward the left connection folding means 49 and the right connection folding means 59, respectively, may be provided in the left auxiliary plates 45 and the right auxiliary plates 55 to cover the left connection folding means 49 and the right connection folding means 59.

Therefore, the foldable box of the present disclosure may more stably protect an item stored therein by using the third cover 48*c* in the same manner of using the first cover 48*a* and the second cover 48*b*.

Figure 6:
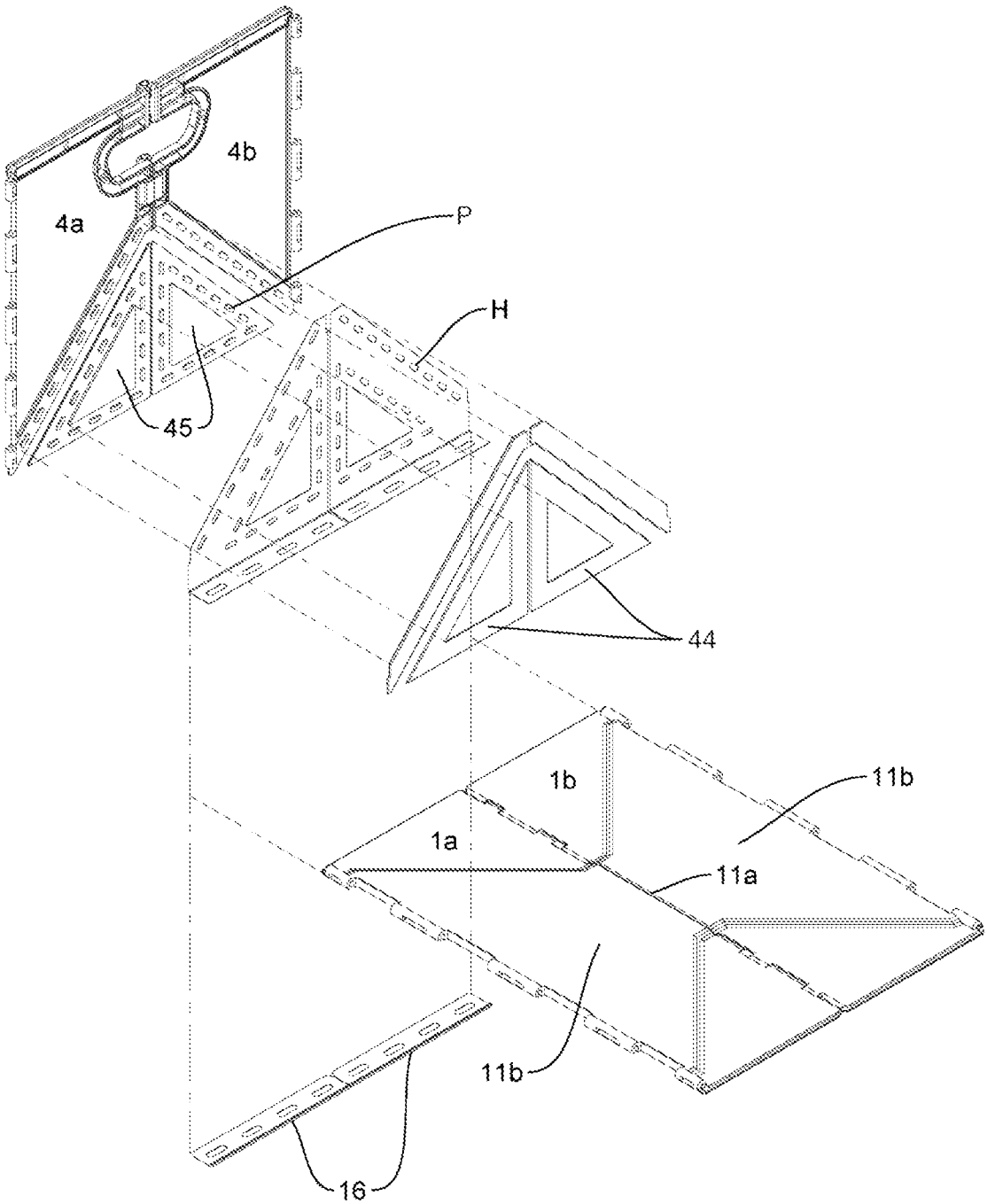
FIGS. 6 and 7 are exploded perspective views of the foldable box according to the first embodiment of the present disclosure.

Meanwhile, referring to FIG. 6, when the left variable folding means 46, the left auxiliary folding means 47, and the left connection folding means 49 are all made of a flexible soft material, fastening protrusions P may be formed in the left auxiliary plates 45 and fastening holes H coupled to the fastening protrusions P may be formed in the left variable folding means 46, the left auxiliary folding means 47, and the left connection folding means 49. Accordingly, the fastening holes H may be fastened to the fastening protrusions P and a left fastening cover 44 and a bottom fastening cover 16 may be coupled to the left auxiliary plates 45, so that the pair of the left plates 4*a* and 4*b* and the pair of the bottom plates 1*a* and 1*b* are connected to the left auxiliary plates 45.

Figure 7:
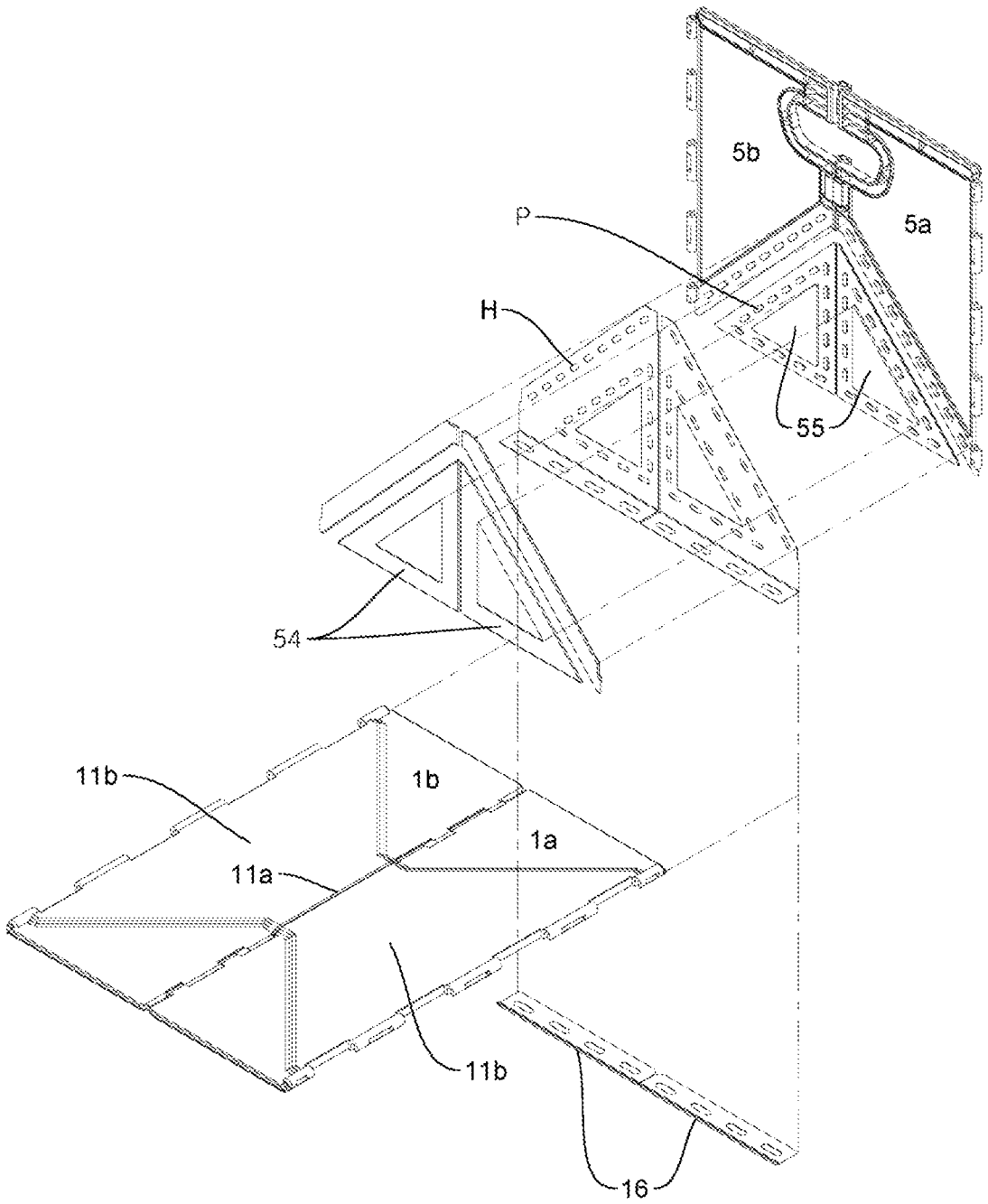

Likewise, referring to FIG. 7, when the right variable folding means 56, the right auxiliary folding means 57, and the right connection folding means 59 are all made of a flexible soft material, the fastening protrusions P may be formed in the right auxiliary plates 55, and fastening holes H coupled to the fastening protrusions P may be formed in the right variable folding means 56, the right auxiliary folding means 57, and the right connection folding means 59. Accordingly, the fastening holes H may be fastened to the fastening protrusions P, and a right fastening cover 54 and a bottom fastening cover 16 may be coupled to the right auxiliary plates 55, so that the pair of the right parts 5*a* and 5*b* and the pair of the bottom plates 1*a* and 1*b* are connected to the right auxiliary plate 55.

According to implementation of the present disclosure, the left variable folding means 46, the right variable folding means 56, the left auxiliary folding means 47, and the right auxiliary folding means 57 may be configured using a soft material with a predetermined area and also may be configured in various ways as follows.

Referring to FIGS. 11 to 15, in the foldable box according to the first embodiment of the present disclosure, the left variable folding means 46 may include a left guide portion 46*a* and a left sliding portion 46*b*, and the right variable folding means 56 may include a right guide portion 56*a* and a right sliding portion 56*b*. The left guide portion 46*a* may be provided in each inner surface of the pair of the left auxiliary plates 45 with a predetermined length. The left sliding portion 46*b* may be provided in each of the left sides of the pair of the bottom plates 1*a* and 1*b* to be slidable while fastened to the left guide portion 46*a* so as to guide a path of the pair of the bottom plates 1*a* and 1*b* to be raised and folded inward along the left guide portion 46*a* and a path of the left auxiliary plates 45 to be folded inward. The right guide portion 56*a* may be provided in each inner surface of the pair of the right auxiliary plates 55 with a predetermined length to guide a path of the pair of the bottom plates 1*a* and 1*b* to be raised and folded inward. The right sliding portion 56*b* may be provided in the right sides of the pair of the bottom plates 1*a* and 1*b* to be slidable while fastened to the right guide portion 56*a* so as to guide a path of the pair of the bottom plates 1*a* and 1*b* to be raised and folded inward along the right guide portion 56*a* and a path of the pair of the right auxiliary plate 55 to be folded inward.

That is, referring to FIG. 12, the left variable folding means 46 is composed of a left guide portion 46*a* and the left sliding portion 46*b* to guide a path along which the left auxiliary plates 45 and the pair of bottom plates 1*a* and 1*b* are raised and folded inward.

Figure 14:
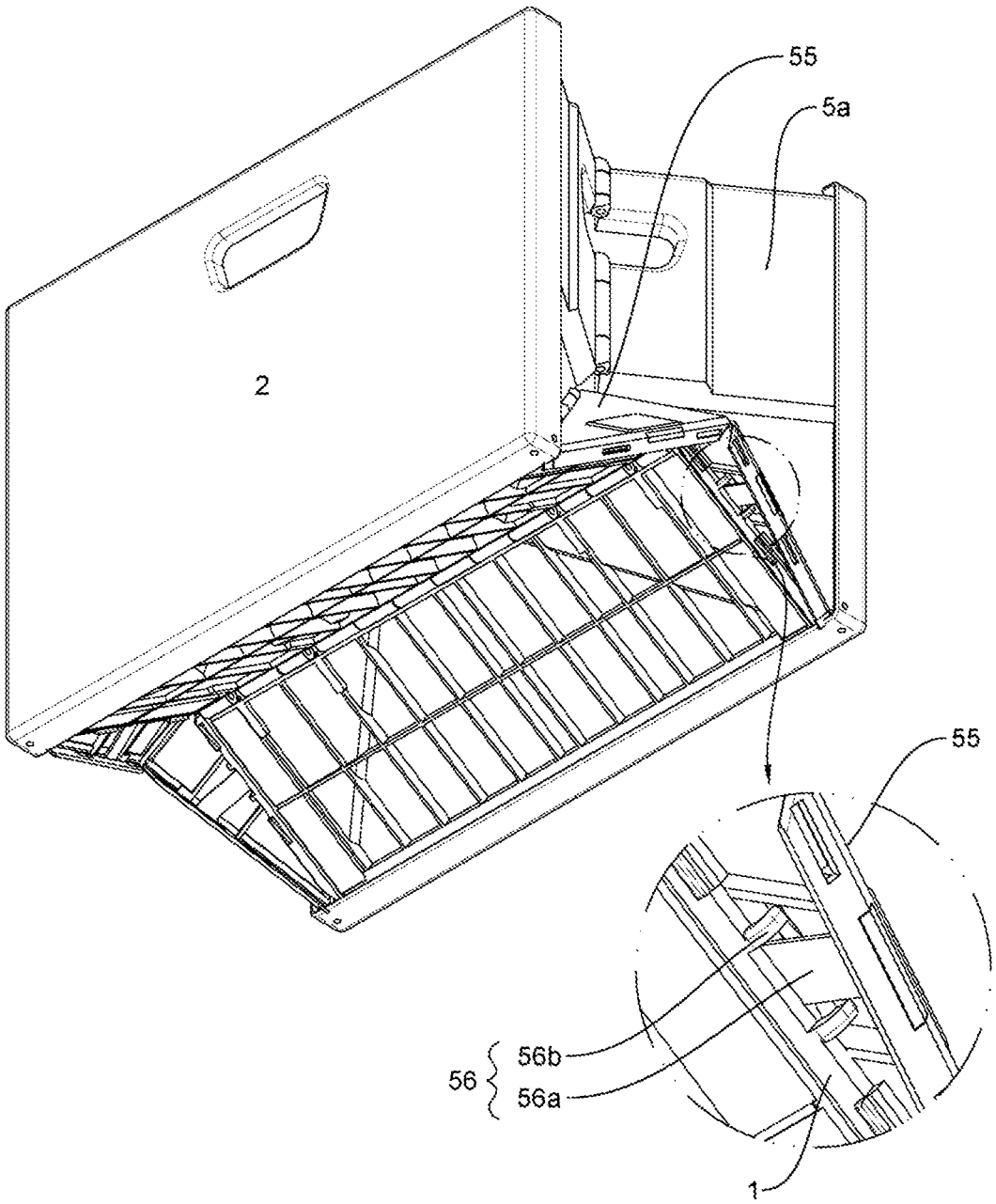
Figure 15A:
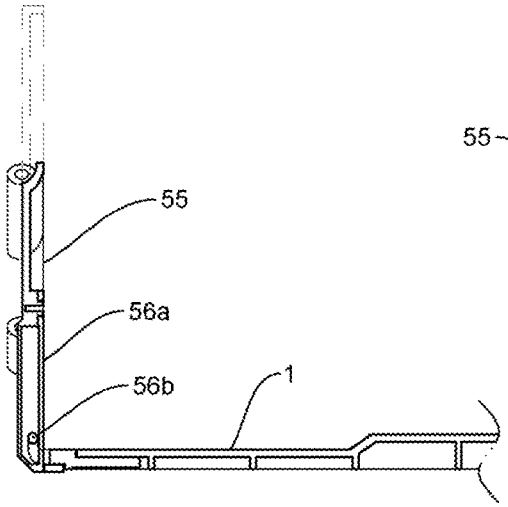
FIGS. 15A to 15C illustrate steps of a folding method by a right variable folding means of the foldable box according to the first embodiment of the present disclosure.
Figure 15B:
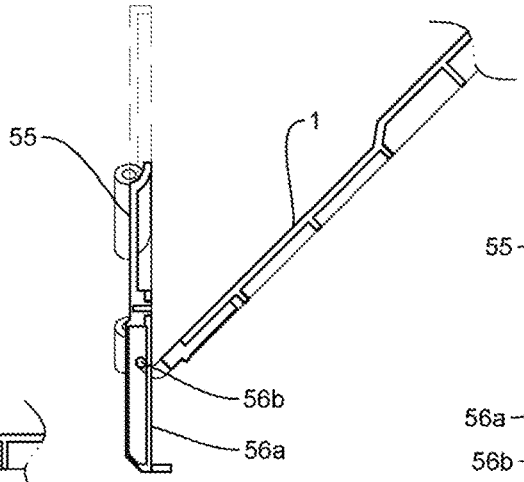
Figure 15C:
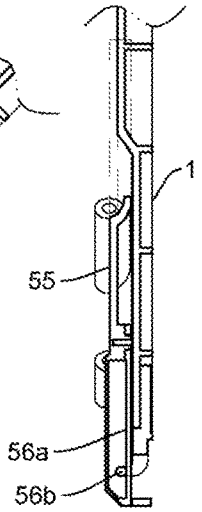
Figure 16:
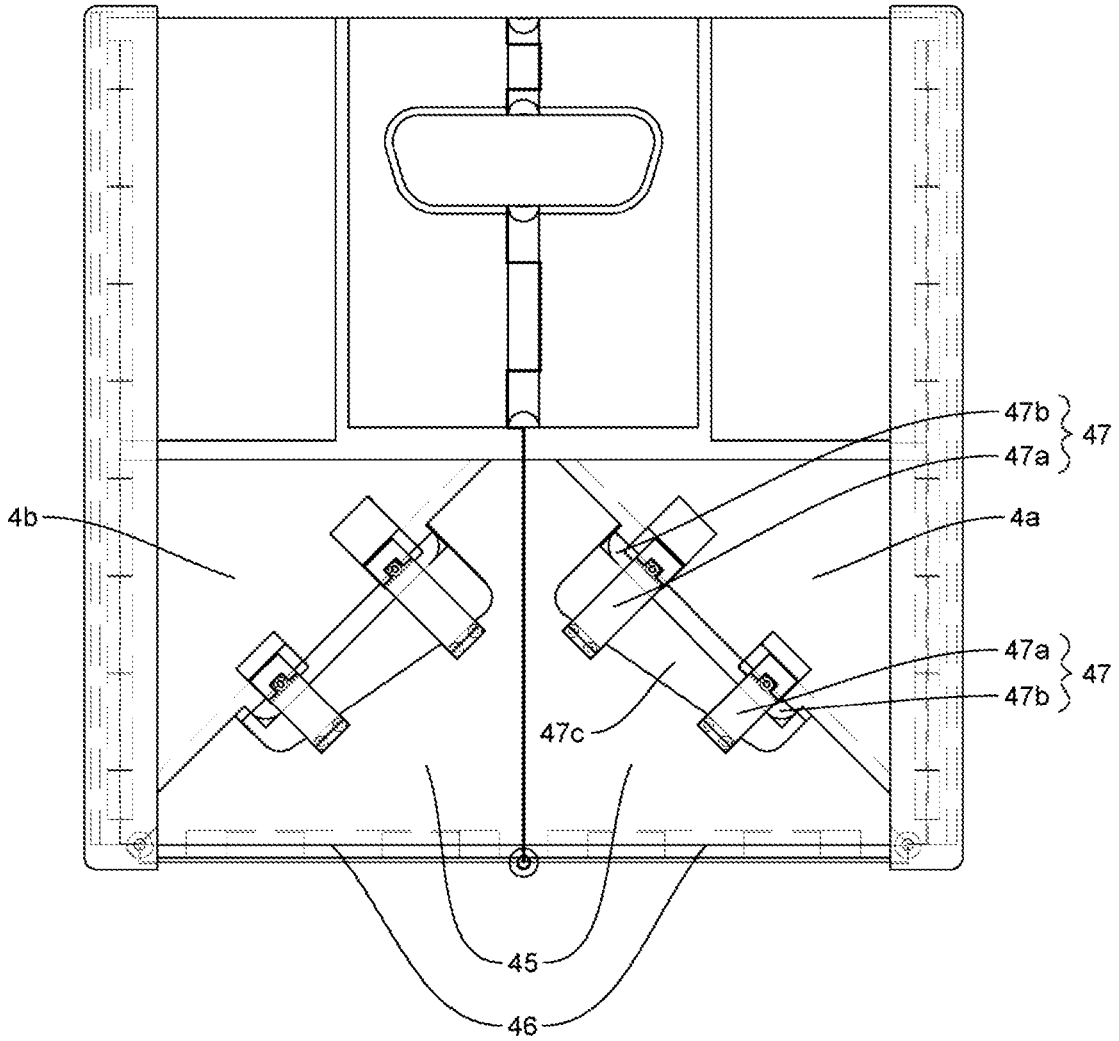
FIG. 16 is a side view of the foldable box according to the first embodiment of the present disclosure.
Figure 17:
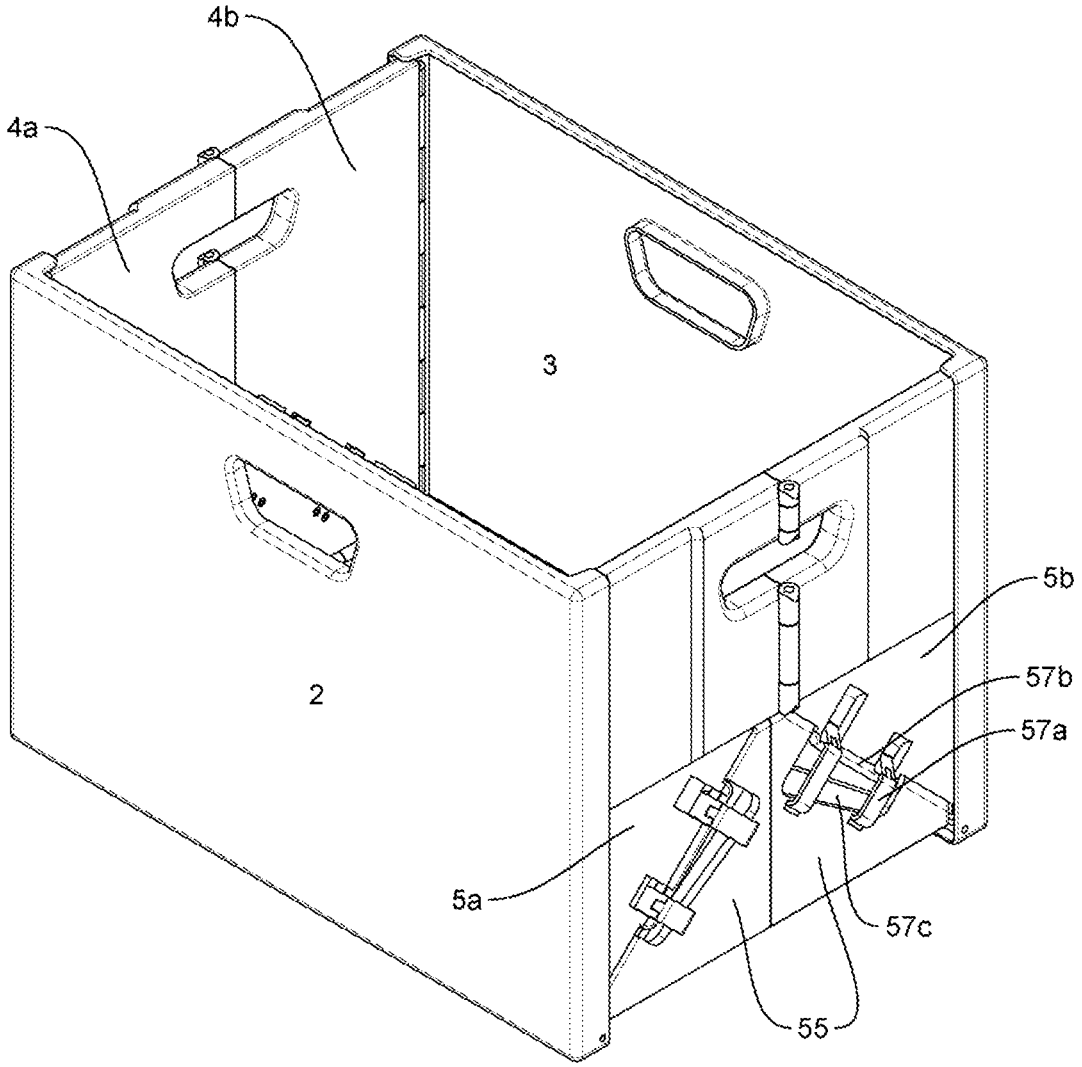
FIG. 17 is a perspective view of the foldable box according to the first embodiment of the present disclosure.

Likewise, referring to FIG. 14, the right variable folding means 56 may be composed of the right guide portion 56*a* and the right sliding portion 56*b* to guide a path along which the right auxiliary plate 55 and the pair of bottom plates 1*a* and 1*b* are raised and folded inward.

In addition, according to implementations of the present disclosure, the pair of left guide portions 46*a* may be formed symmetrically obliquely toward the front part 2 and the rear part 3 to become distal away from each other toward the upper parts, respectively, and the left sliding portion 46*b* may be configured in a ring shape to allow stable sliding along the left guide portion 46*a* while being caught by the left guide portion 46*a*.

Likewise, according to implementations of the present disclosure, the pair of right guide portions 56*a* may be formed symmetrically obliquely toward the front part 2 and the rear part 3 to become distal away from each other toward the upper parts, respectively, and the right sliding portion 56*b* may be configured in a ring shape to allow stable sliding along the right guide portion 56*a* while being caught by the right guide portion 56*a*.

Accordingly, a path of the pair of the bottom plates 1*a* and 1*b* to be raised and folded inward is guided by the left variable folding means 46 and the right variable folding means 56, and a path of the left auxiliary plates 45 and the right auxiliary plate 55 to be raised and folded inward is guided. As a result, the pair of the bottom plates 1*a* and 1*b*, the left auxiliary plates 45, and the right auxiliary plates 55 may be completely folded inward.

Figure 11A:
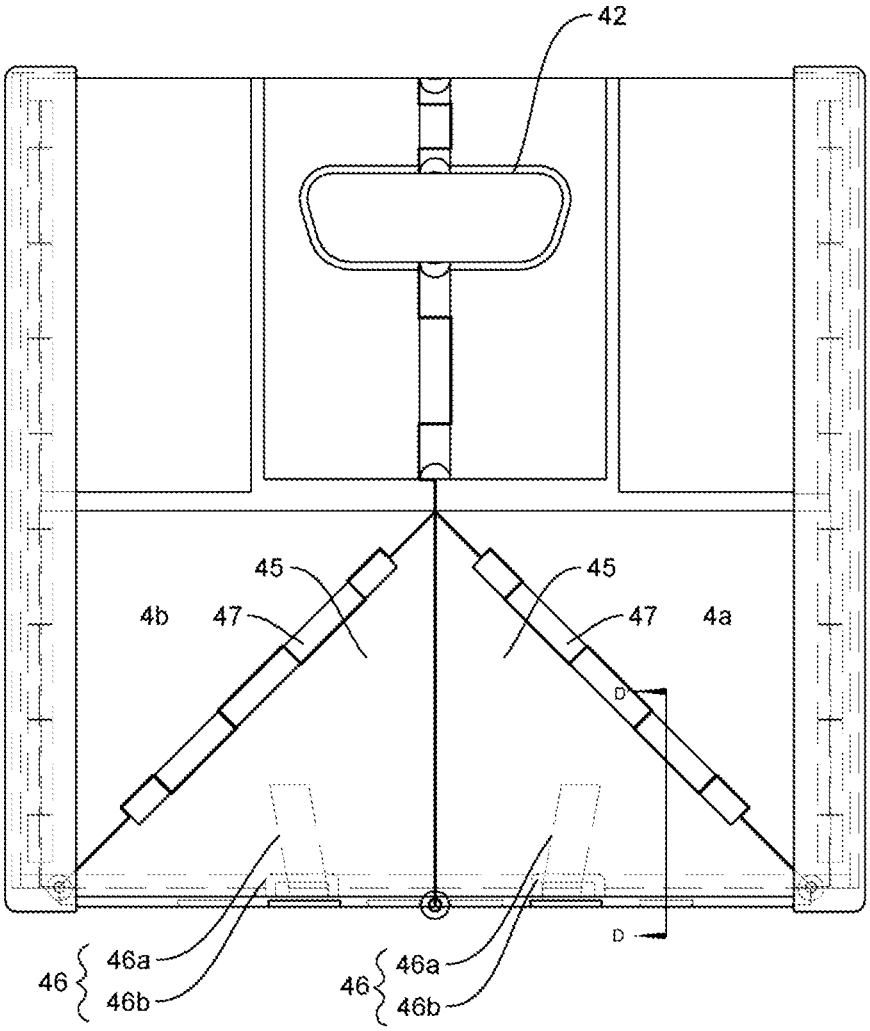
FIG. 11A is a side view of the foldable box according to the first embodiment of the present disclosure.
Figure 11B:
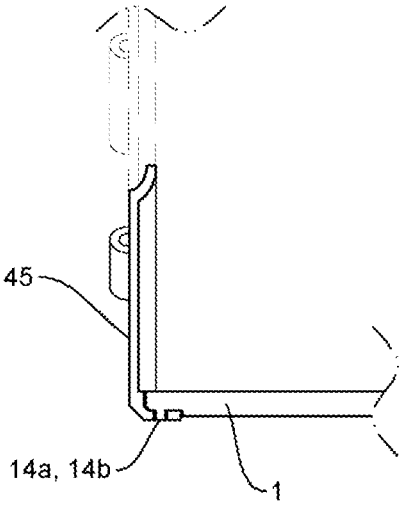
FIG. 11B is a cross sectional view taken along line D-D' shown in FIG. 11A.
Figure 11C:
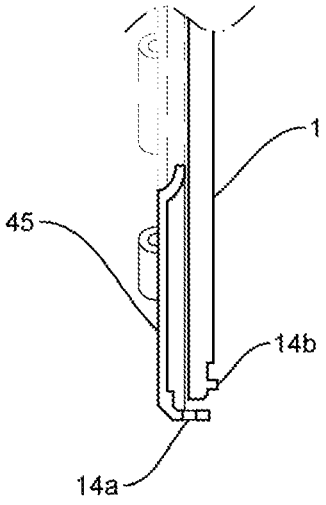
FIG. 11C is a cross sectional view taken along the line D-D' when the foldable box of FIG. 11A is folded.

In addition, referring to FIG. 11, bottom fastening grooves 14*a* may be formed in the left auxiliary plates 45 and the right auxiliary plate 55, and bottom fastening step 14*b* to be fastened to the bottom fastening grooves 14*a* may be formed in the bottom plates 1*a* and 1*b*, so that the bottom plates 1*a* and 1*b*, the left auxiliary plates 45, and the right auxiliary plates 55 are fastened to one another more stably when the foldable box is unfolded.

Therefore, in the present disclosure, when the bottom part 1 is unfolded, the bottom fastening step 14*b* may be fastened to the bottom fastening grooves 14*a* formed in the left auxiliary plates 45 and the right auxiliary plates 55, so that the unfolded bottom part 1 are stably connected to the left auxiliary plates 45 and the right auxiliary plates 55.

Likewise, in the present disclosure, since the left variable folding means 46 is composed of the left guide portion 46*a* and the left sliding portion 46*b*, and the right variable folding means 56 is composed of the right guide portion 56*a* and the right sliding portion 56*b*, As a result, the bottom part 1, the left part 4, the right part 5, the left auxiliary plate 45, and the right auxiliary plates 55 which are made of a hard material, may be all foldable inward, and a stored item may be stably protected from an external impact.

In addition, in the present disclosure, when the left variable folding means 46 is composed of the left guide portion 46*a* and the left sliding portion 46*b* and the right variable folding means 56 is composed of the right guide portion 56*a* and the right sliding portion 56*b*, the left auxiliary folding means 47 and the right auxiliary folding means 57 may be provided as hinges, but not limited thereto.

On the other hand, referring to FIGS. 16 to 20, in the foldable box according to the first embodiment of the present disclosure, the left auxiliary folding means 47 may include a first left fastening portion 47*a* and a second left fastening portion 47*b*, and the right auxiliary folding means 57 may include a first right fastening portion 57*a* and a second right fastening portion 57*b*. The first left fastening portion 47*a* and the second left fastening portion 47*b* may be formed in the left auxiliary plates 45 and the left plates 4*a* and 4*b*, respectively, and engaged with each other, so that the left auxiliary plates 45 and the left plates 4*a* and 4*b* are folded inward when the pair of the bottom plates 1*a* and 1*b* are raised and folded inward. The first right fastening portion 57*a* and the second right fastening portion 57*b* may be respectively formed in the right auxiliary plate 55 and the right plates 5*a* and 5*b* and engaged with each other, so that the right auxiliary plate 55 and the right plates 5*a* and 5*b* are folded inward when the pair of the bottom plates 1*a* and 1*b* are raised and folded inward.

That is, the left auxiliary plates 45 and the left plates 4*a* and 4*b* may be folded inward when the pair of the bottom plates 1*a* and 1*b* are raised and folded inward by the first left fastening portion 47*a*, which is formed in the left auxiliary plates 45, and the second left fastening portion 47*b*, which is formed in the left plates 4*a* and 4*b* to be engaged with the first left fastening portion 47*a*.

Likewise, the right auxiliary plate 55 and the right plates 5*a* and 5*b* may be folded inward when the pair of the bottom plates 1*a* and 1*b* are raised and folded inward by the first right fastening portion 57*a*, which is formed in the right auxiliary plate 55, and the second right fastening portion 57*b*, which is formed in the right plates 5*a* and 5*b* to be engaged with the first right fastening portion 57*a*.

In addition, in some implementations, a left fastening groove 47*c* may be recessed inward in the left auxiliary plates 45 to provide a path along which the second left fastening portion 47*b* fastened to the first left fastening portion 47*a* slides.

Figure 18:
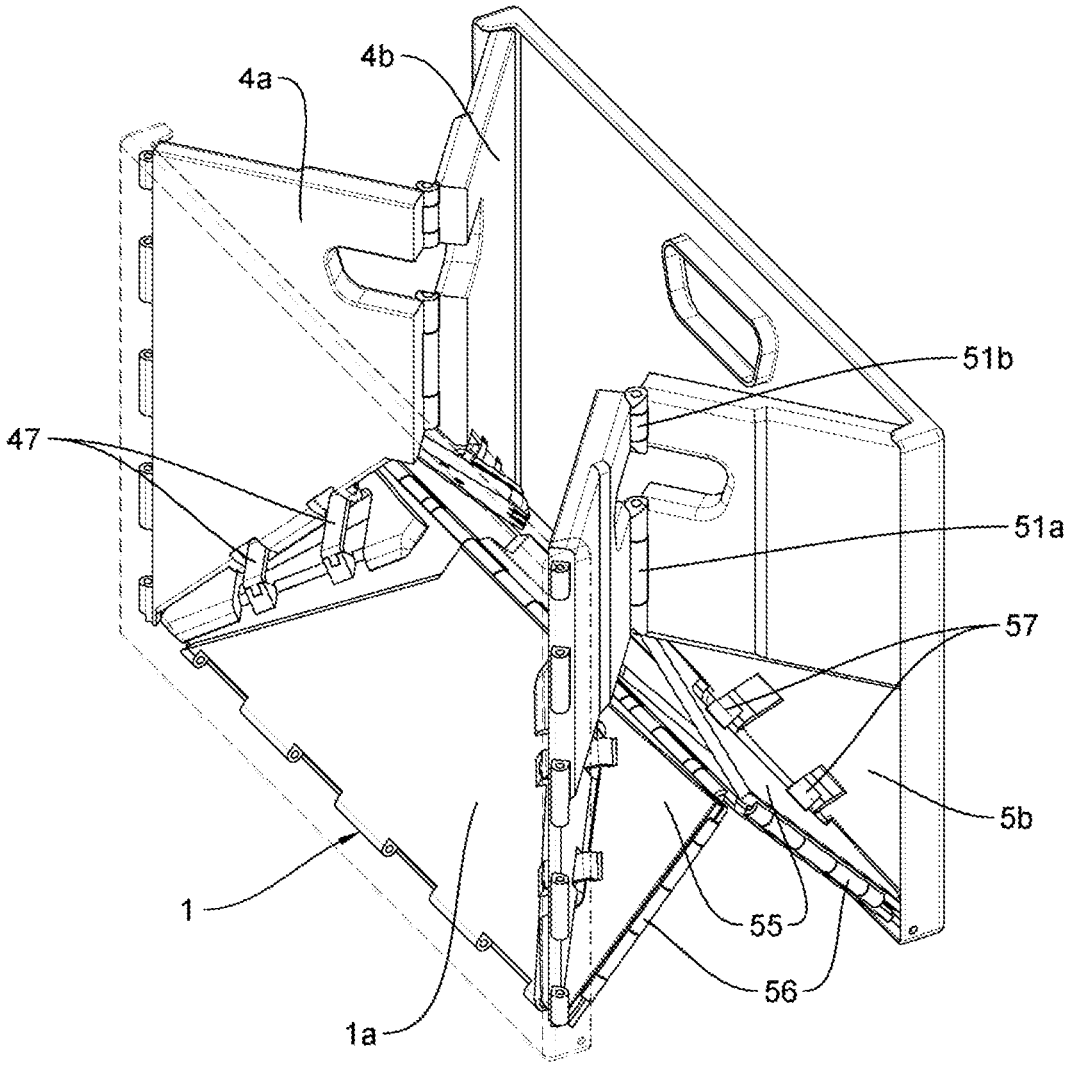
FIG. 18 is a perspective view illustrating a folding method of the foldable box according to the first embodiment of the present disclosure.
Figure 19:
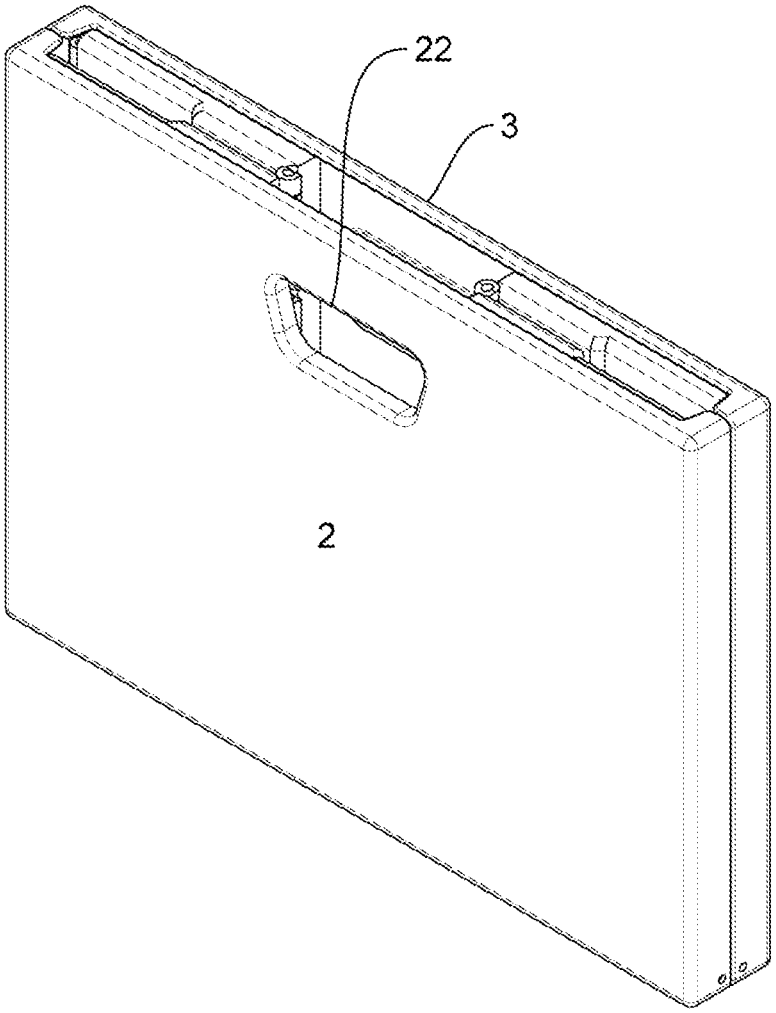
FIG. 19 is a perspective view illustrating a folded state of the foldable box according to the first embodiment of the present disclosure.
Figure 20A:
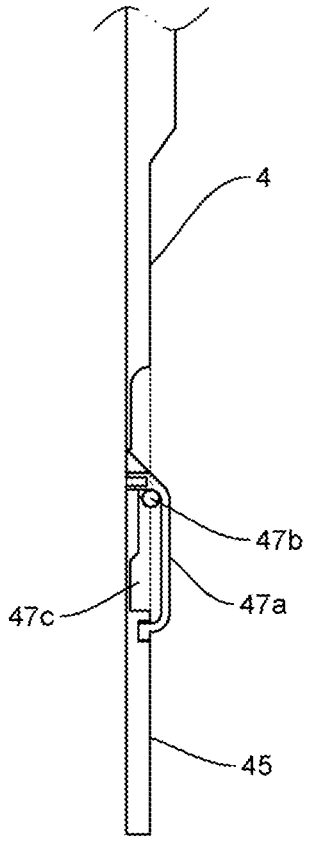
FIGS. 20A to 20C illustrate steps of a folding method by a left auxiliary folding means of the foldable box according to the first embodiment of the present disclosure.
Figure 20B:
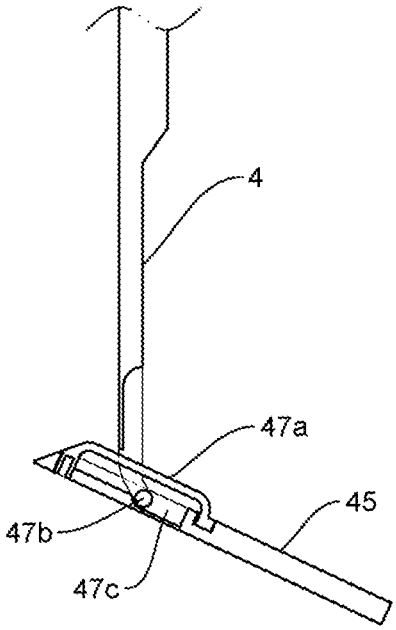
Figure 20C:
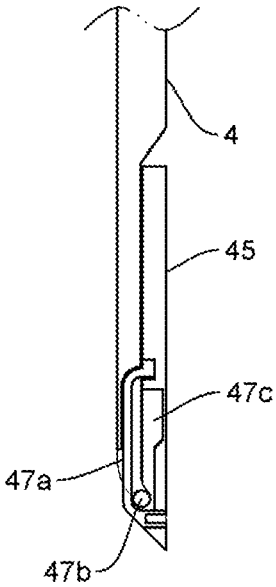

Therefore, referring to FIGS. 18 to 20, when the pair of the bottom plates 1*a* and 1*b* is raised and folded inward, the left auxiliary plates 45 and the left plates 4*a* and 4*b* may be completely folded inward together as the second left fastening portion 47*b* fastened to the first left fastening portion 47*a* slides along the left fastening groove 47*c*.

Likewise, in some implementations, a right fastening groove 57*c* may be recessed inward in the right auxiliary plate 55 to provide a path along which the second right fastening portion 57*b* fastened to the first right fastening portion 57*a* slides.

Therefore, referring to FIGS. 18 to 20, when the pair of the bottom plates 1*a* and 1*b* is raised and folded inward, the right auxiliary plate 55 and the right plates 5*a* and 5*b* may be completely folded inward together as the second right fastening portion 57*b* fastened to the first right fastening portion 57*a* slides along the right fastening groove 57*c*.

As such, in the present disclosure, the first left fastening portion 47*a* and the second left fastening portion 47*b* are provided in the left auxiliary plates 45 and the left plates 4*a* and 4*b*, and the first right fastening portion 57*a* and the second right fastening portion 57*b* are provided in the right auxiliary plate 55 and the right plates 5*a* and 5*b*. As a result, the bottom part 1, the left part 4, the right part 5, the left auxiliary plate 45, and the right auxiliary plates 55 which are made of a hard material, may be folded inward, and an item stored inside may be protected stably from an external impact.

Figure 24:
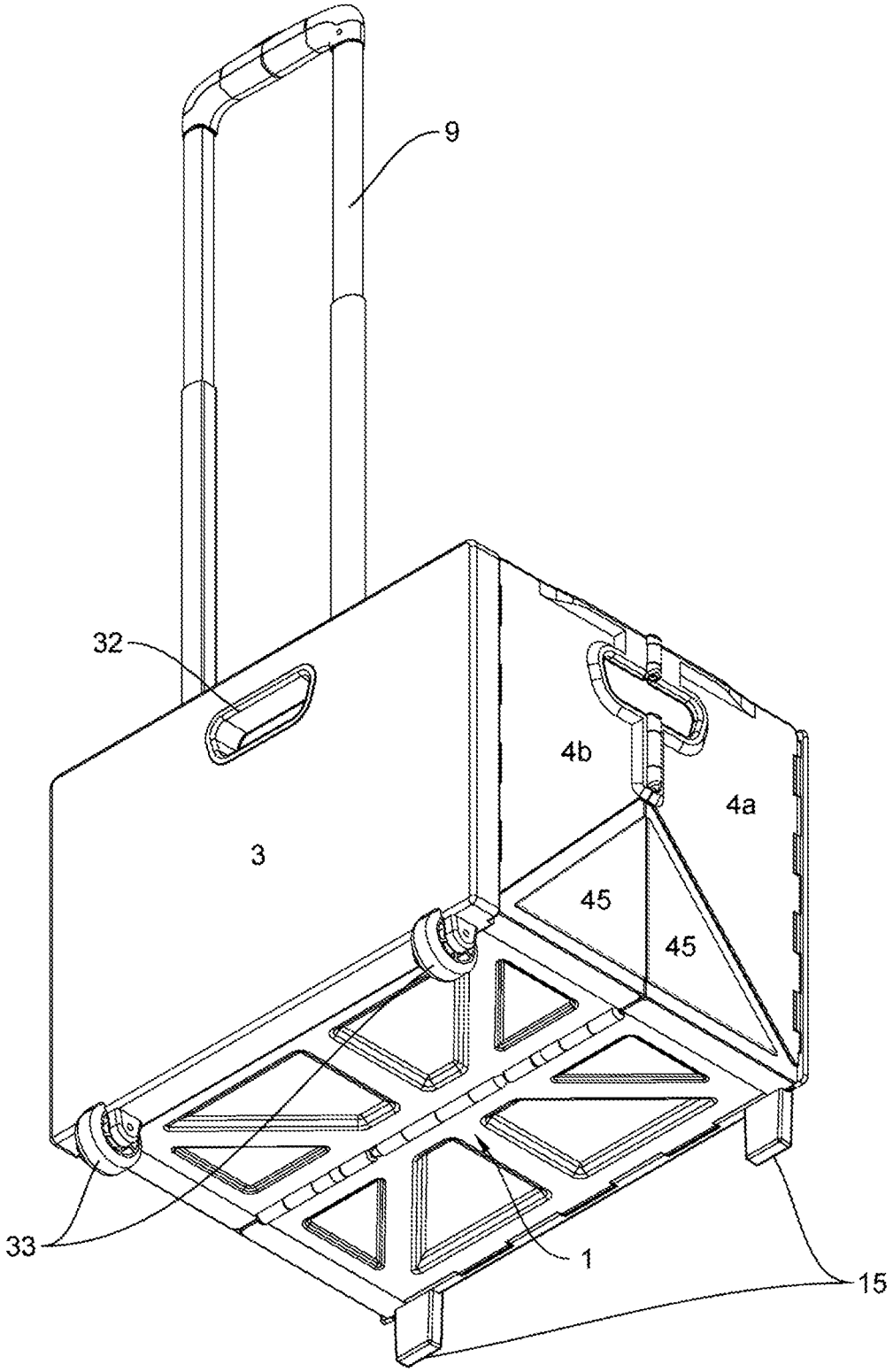
FIGS. 24 to 26 illustrate a state in which a wheel and a handle are provided in the foldable box according to the first embodiment of the present disclosure.

Additionally, referring to FIG. 24, in the foldable box according to the first embodiment of the present disclosure, one or more rear wheels 33 for moving the foldable box may be provided below the rear part 3.

That is, one or more rear wheels 33 for moving the foldable box may be formed in the lower side of the rear part 3 to protrude toward the ground. When the rear wheels 33 are provided in the foldable box, bottom pedestals 15 may be provided in the front part 2 or the bottom part 1 at opposite positions corresponding to the rear wheels 33 to protrude toward the ground. Therefore, when the foldable box is placed on the ground, the foldable box may be maintained stably in a stable state on the ground by using the rear wheels 33 and the bottom pedestals 15.

Figure 25:
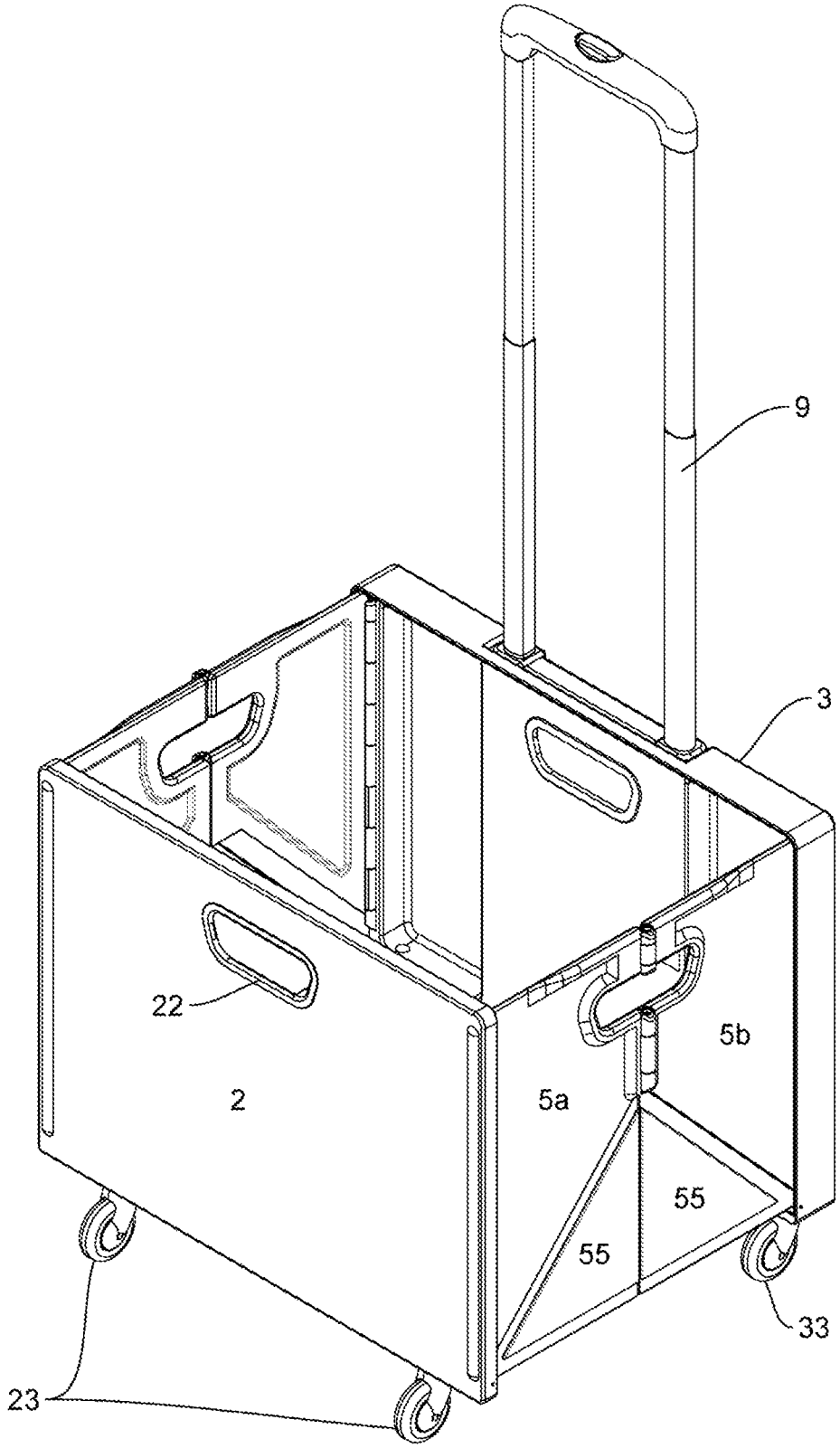
Figure 26:
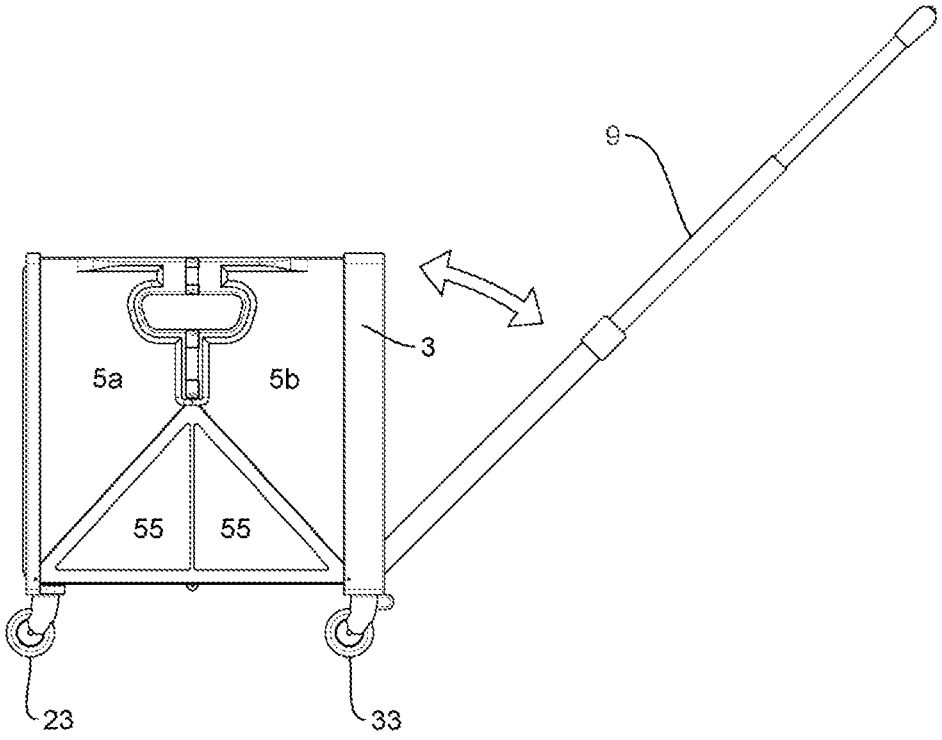

In addition, referring to FIG. 25, in the foldable box according to the first embodiment of the present disclosure, one or more front wheels 23 for moving the foldable box may be provided below the front part 2.

Therefore, when the rear wheels 33 are provided below the rear part 3, one or more front wheels 23 for moving the foldable box may be provided below the front part 2. The front wheels 23 may be provided at opposite positions corresponding to the rear wheels 33 to protrude toward the ground.

Referring to 24 to 26, the foldable box according to the first embodiment of the present disclosure may further include a handle 9 provided in the rear part 3 to allow a user to carry the foldable box. The handle 9 may be configured to be inclined toward the user when the user carries the foldable box.

That is, when the rear wheels 33 are provided in the rear part 3 or when the front wheels 23 and the rear wheels 33 are respectively provided in the front part 2 and the rear part 3, the handle 9 may be configured on one side of the rear part 3 in the form of a tilting handle that is operable to tilt toward the user.

Therefore, in the present disclosure, when the front wheels 23 and the rear wheels 33 are provided, the user is able to more conveniently move the foldable box, where an item is stored, by using the handle 9 that tilts toward the user.

Figure 27:
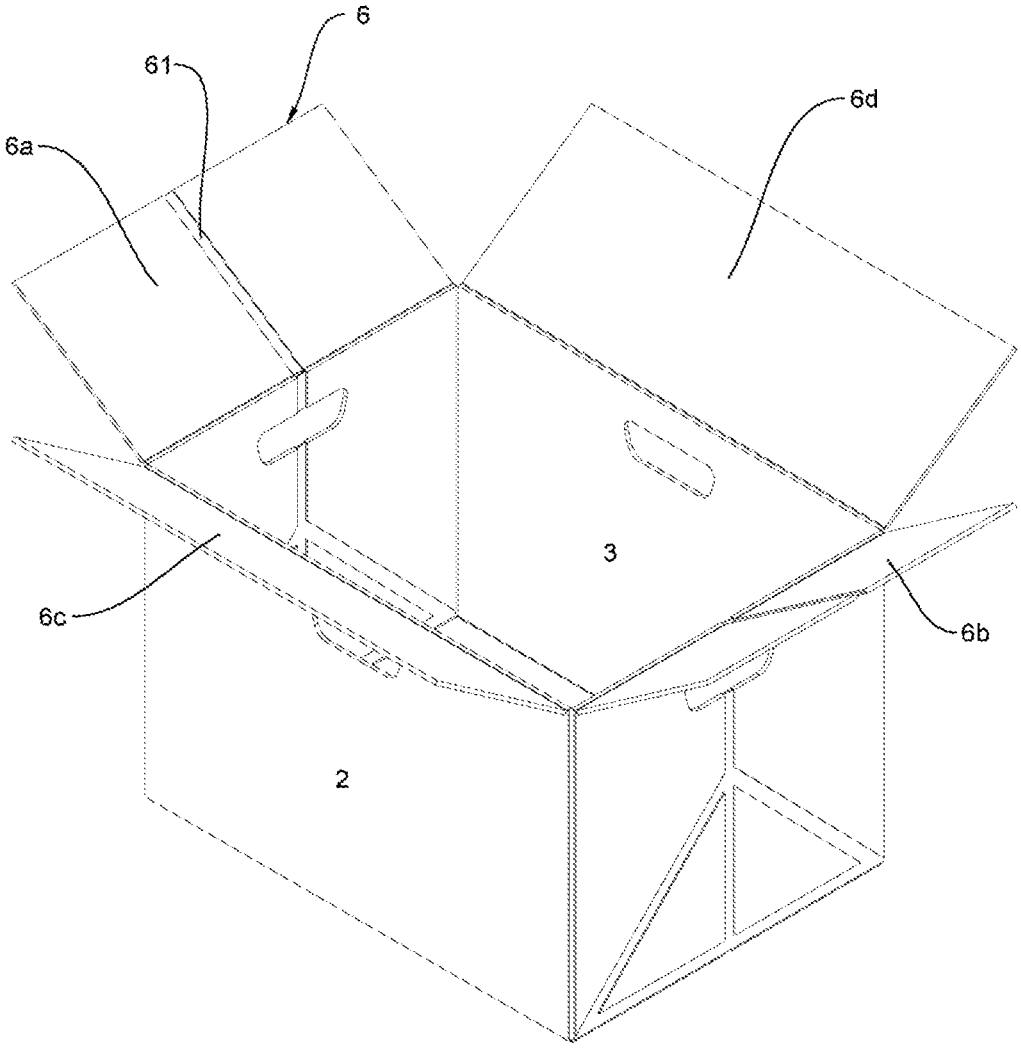
FIG. 27 illustrates a state in which a box lid is provided in the foldable box according to the first embodiment of the present disclosure.

Referring to FIG. 27, the foldable box according to the first embodiment of the present disclosure may further include a box lid 6 for covering or opening an open upper side of the foldable box.

That is, the present disclosure may stably protect or store an item stored inside by covering or opening the open upper side of the box lid 6. In addition, when the box lid 6 is provided to be connected to the upper end of the left part 4 or the right part 5, the box lid 6 may be provided with a lid folding means 61 which is provided separate along the boundary between the left folding means 41 and the right folding means 51 or which is connected to the left folding means 41 or the right folding means 51.

Accordingly, when the left part 4 and the right part 5 are folded inward by the lid folding means 61, the box lid 6 may be configured to be folded inward at the same time.

In addition, in some implementations, the box lid 6 may further include a first upper lid 6*a*, a second box lid 6*b*, a third box lid 6*c*, and a fourth box lid 6*d*. The first upper lid 6*a* and the second box lid 6*b* may be respectively connected to the upper ends of the left part 4 and the right part 5 and provided with the lid folding means 61. The third box lid 6*c* and the fourth box lid 6*d* may be respectively connected to the upper ends of the front part 2 and the rear part 3.

Figure 28:
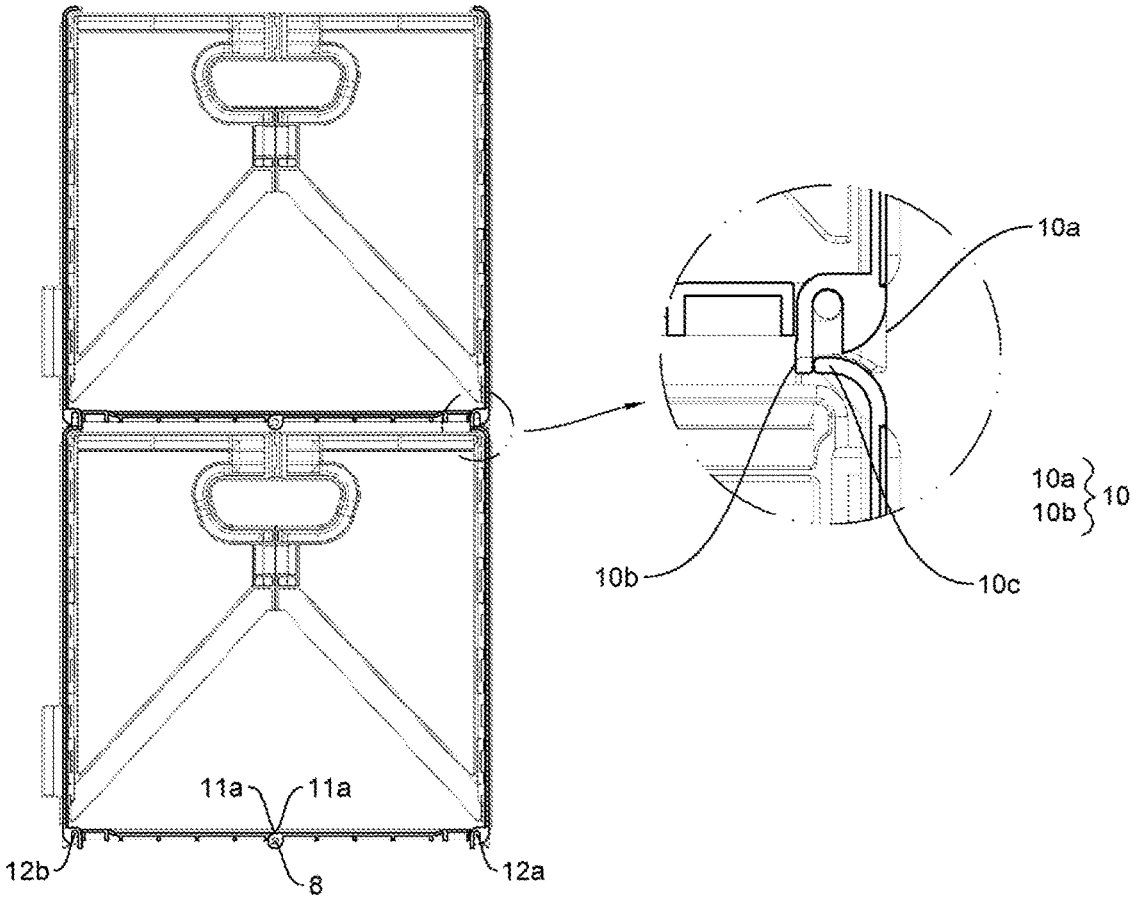
FIG. 28 illustrates a two-layer piled state of the foldable box according to the first embodiment of the present disclosure.

In addition, referring to FIG. 28, in some implementations of the present disclosure, when at least two or more foldable boxes are stacked in an unfolded state, stacking protrusions 10 may be formed in the lower ends of the front part 2 and the rear part 3 to fix the positions of the stacked foldable boxes. In this case, the stacking protrusions 10 may include an outer stacking protrusion 10*a* and an inner stacking protrusion 10*b*. The outer stacking protrusions 10*a* and the inner stacking protrusions 10*b* may be respectively formed at the inside and the outside of the bottom end of the front part 2 or the rear part 3 to fix front-and-rear positions of the foldable boxes that are stacked in two or more layers. In addition, in order to fix the left-and-right positions of the fordable boxes stacked in two or more layers, stacking groove 10*c* coupled to the stacking protrusion 10 may be formed at the upper ends of the front part 2 and the rear part 3. Therefore, when two or more foldable boxes are stacked, it is possible to stably fix front-and-rear and left-and-right positions of the foldable boxes that are stacked as the stacking protrusions 10 and the stacking groove 10*c* are coupled.

Description of Foldable Box According to Second Embodiment

Hereinafter, a foldable box according to a second embodiment of the present disclosure will be described in detail. However, a redundant description with the foldable box according to the first embodiment will be omitted, and only the configuration different from the foldable box according to the first embodiment will be described.

Figure 29:
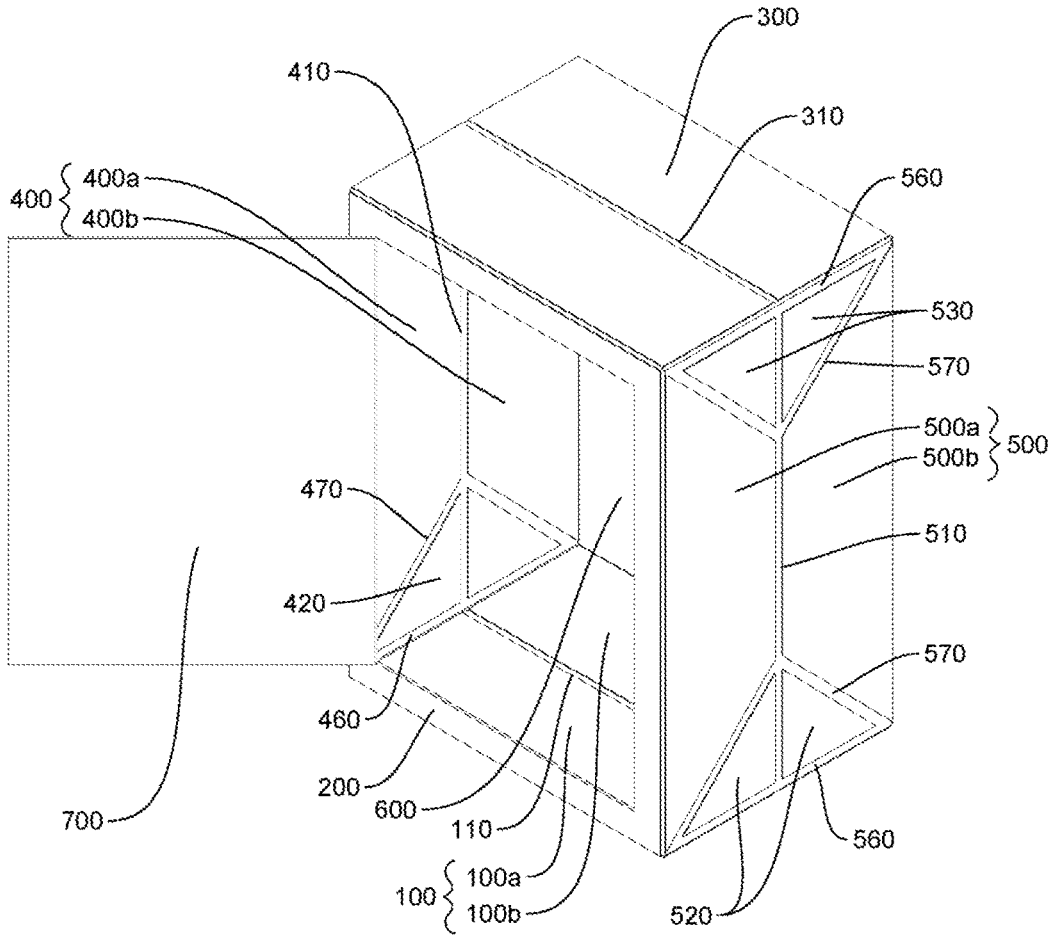
FIG. 29 is a perspective view of a foldable box according to a second embodiment of the present disclosure.

Referring to FIG. 29, a foldable box according to a second embodiment of the present disclosure may include a bottom part 100 including a pair of bottom plates 100*a* and 100*b* to be folded inward by one or more bottom folding means 110, an upper part 300 positioned at an upper side of the bottom part 100 and including a pair of upper plates to be folded inward by one or more upper folding means 310, a left part 400 connected to a left side of the bottom part 100 and including a pair of left plates 400*a* and 400*b* to be folded inward by one or more left folding means 410, and a right part 500 connected to a right side of the bottom part 100 and including a pair of right plates 500*a* and 500*b* to be folded inward by one or more right folding means 510. The left part 400 may include a pair of first left auxiliary plates 420 and a pair of second left auxiliary plates (not shown). The pair of the first left auxiliary plates 420 may include lower sides respectively connected to the left sides of the pair of the bottom plates 100*a* and 100*b* by a left variable folding means 460, and left and right sides respectively connected to the left plates 400*a* and 400*b* by the pair of the left auxiliary folding means 470, so that the pair of the first left auxiliary plates 420 are provided adjacent to be folded inward when the left plates 400*a* and 400*b* are folded inward. The pair of the second left auxiliary plates (not shown) may include upper sides respectively connected to the left sides of the pair of the upper plates by the left variable folding means 460, and left and right sides respectively connected to the left plates 400*a* and 400*b* by the pair of the left auxiliary folding means 470, so that the pair of the second left auxiliary plates (not shown) are provided adjacent to be folded inward when the left plates 400*a* and 400*b* are folded inward. The right part 500 may include a pair of first right auxiliary plates 520 and a pair of second right auxiliary plates 530. The pair of the first right auxiliary plates 520 may be provided adjacent to be folded inward when the right plates 500*a* and 500*b* are folded inward, because lower sides of the pair of the first right auxiliary plates 520 are connected to the right sides of the pair of the bottom plates 100*a* and 100*b* by a right variable folding means 560 and left and right sides of the pair of the first right auxiliary plates 520 are connected to the right plates 500*a* and 500*b* by the pair of the right auxiliary folding means 570. The pair of the second right auxiliary plates 530 is provided adjacent to be folded inward when the right plates 500*a* and 500*b* are folded inward, because upper sides of the pair of the second right auxiliary plates 530 are connected to the right sides of the pair of the upper plates by the right variable folding means 560 and left and right sides of the pair of the second right auxiliary plates 530 are connected to the right plates 500*a* and 500*b* by the pair of the right auxiliary folding means 570. The first left auxiliary plate 420, the first right auxiliary plate 520, the second left auxiliary plate (not shown), and the second right auxiliary plate 530 may be configured to be folded inward by the left variable folding means 460, the right variable folding means 560, the pair of the left auxiliary folding means 470, and the pair of the right auxiliary folding means 570 when the bottom part 100, the upper part 300, the left part 400, and the right part 500 are folded inward. The front part 200 located at a front side of the bottom part 100 or the rear part 600 located at a rear side of the bottom part 100 may be open at a portion.

That is, the foldable box according to the second embodiment of the present disclosure is configured in a structure in which, when the left part 400 is folded inward, the bottom part 100 and the upper part 300 may be folded inward, the first left auxiliary plate 420 and the second left auxiliary plate (not shown) may be folded inward, and, in turn, the first right auxiliary plate 520 and the second right auxiliary plate 530 may be folded or unfolded inward.

The foldable box according to the second embodiment of the present disclosure may further include an opening lid 700 for covering or opening an opened portion of the front part 200 or the rear part 600.

Accordingly, the foldable box according to the second embodiment of the present disclosure may store an item therein through the opened front part 200 or the opened rear part 600 and may cover the opened front part 200 or the opened rear part 600 with the opening lid 700, thereby stably protecting the item stored therein from an external impact.

According to the present disclosure, the left part and the right part of the foldable box are provided with left auxiliary plates and right auxiliary plates, and most of the side parts of the foldable box are made of a hard material, so that an item stored in the foldable box may be protected from an external impact and the foldable box may be easily folded or unfolded, thereby maximizing convenience of storage and use.

As described above, although embodiments of the present disclosure are described in detail, it is understood that the present disclosure is limited to the above embodiments only because the above-described embodiments have only been described with reference to preferred examples of the present disclosure. The scope of the invention should be understood as the claims and equivalent concepts described below.

We claim:

1. A foldable box comprising:

a bottom part comprising a pair of bottom plates folded inward by one or more bottom folding means;

a front part connected to a front side of the bottom part;

a rear part connected to a rear side of the bottom part;

a left part connected to a left side of the bottom part and including a pair of primary left plates to be folded inward by one or more left folding means; and a right part connected to a right side of the bottom part and including a pair of primary right plates to be folded inward by the one or more right folding means, wherein the left part comprises a pair of auxiliary left plates provided adjacent to each other, said pair of auxiliary left plates to be folded inward when the pair of primary left plates are folded inward, wherein lower edges of the pair of auxiliary left plates are connected to left sides of the pair of the bottom plates by a left variable folding means, and upper edges of the pair of auxiliary left plates are connected to the pair of primary left plates by a pair of left auxiliary folding means, wherein the right part comprises a pair of auxiliary right plates provided adjacent to each other, said pair of auxiliary right plates to be folded inward when the pair of primary right plates are folded inward, wherein lower edges of the pair of auxiliary right plates are connected to right sides of the pair of the bottom plates by a right variable folding means, and upper edges of the pair of auxiliary right plates are connected to the pair of primary right plates by a pair of right auxiliary folding means, wherein the pair of the auxiliary left plates and the pair of auxiliary right plates are folded inward by the left variable folding means, the right variable folding means, the pair of the left auxiliary folding means, and the pair of the right auxiliary folding means when the bottom part, the left part, and the right part are folded inward, wherein the left variable folding means comprises:

a left guide portion provided in each inner surface of the pair of the auxiliary left plates with a predetermined length; and a left sliding portion provided in each of the left sides of the pair of the bottom plates to be slidable while fastened to the left guide portion so as to guide a path of the pair of the bottom plates to be raised and folded inward along the left guide portion and a path of the pair of the auxiliary left plates to be folded inward, and wherein the right variable folding means comprises:

a right guide portion provided in each inner surface of the pair of the auxiliary right plates with a predetermined length to guide a path of the pair of the bottom plates to be raised and folded inward; and a right sliding portion provided in each of the right sides of the pair of the bottom plates to be slidable while fastened to the right guide portion so as to guide a path of the pair of the bottom plates to be raised and folded inward along the right guide portion and a path of the auxiliary right plate to be folded inward.

2. The foldable box of claim 1, wherein a left hinge magnet and a right hinge magnet are respectively provided in the one or more left folding means and the one or more right folding means to increase a fixing force in a state in which the left part and the right part are unfolded.

3. The foldable box of claim 1, wherein an elastic body is provided in the bottom part to provide elasticity to the one or more bottom folding means and the pair of the bottom plates when the pair of the bottom plates are folded inward.

4. The foldable box of claim 1, further comprising a box lid for covering or opening an open upper side of the foldable box.

* * * * *